US005957624A

United States Patent [19]

Carter, Jr. et al.

[11] Patent Number: 5,957,624

[45] Date of Patent: *Sep. 28, 1999

[54] APPARATUS AND METHOD FOR IN SITU INSTALLATION OF UNDERGROUND CONTAINMENT BARRIERS UNDER CONTAMINATED LANDS

[75] Inventors: Ernest E. Carter, Jr., Sugar Land; Frank L. Sanford, Houston; R. Kent Saugier, Katy, all of Tex.

[73] Assignee: Lockheed Martin Idaho Technologies Company, Idaho Falls, Id.

[ * ] Notice: This patent is subject to a terminal disclaimer.

[21] Appl. No.: 09/023,250

[22] Filed: Feb. 13, 1998

Related U.S. Application Data

[63] Continuation of application No. 08/286,837, Aug. 5, 1994, Pat. No. 5,765,965, which is a continuation-in-part of application No. 08/021,124, Feb. 23, 1993, Pat. No. 5,542,782, which is a continuation-in-part of application No. PCT/US92/05303, Jun. 22, 1992, application No. 07/719,863, Jun. 24, 1991, and application No. 07/774,015, Oct. 7, 1991.

[51] Int. Cl.[6] ..... E02D 5/20

[52] U.S. Cl. ..... 405/129; 405/248; 405/267

[58] Field of Search ..... 405/129, 267, 405/248, 266, 269, 303; 175/67, 17, 16; 299/16, 17, 14, 11; 37/307, 342, 344, 343, 335, 349

[56] References Cited

U.S. PATENT DOCUMENTS

| | | | |
|---|---|---|---|
| 301,682 | 7/1884 | Coiseau | 371/78 |
| 1,237,310 | 8/1917 | Dobson . | |
| 2,048,710 | 7/1936 | Ranney | 405/267 |
| 3,132,852 | 5/1964 | Dolbear | 175/67 |
| 3,599,354 | 8/1971 | Larson . | |
| 3,645,101 | 2/1972 | Sherard . | |
| 3,688,507 | 9/1972 | Muller . | |
| 3,802,203 | 4/1974 | Ischise et al. . | |
| 3,999,312 | 12/1976 | Yamaguchi et al. . | |

(List continued on next page.)

FOREIGN PATENT DOCUMENTS

| | | | |
|---|---|---|---|
| 0189158 | 7/1986 | European Pat. Off. | 405/129 |
| WO 93/00483 | 1/1993 | European Pat. Off. . | |
| 2121878 | 8/1972 | France . | |
| 3439858 | 10/1984 | Germany . | |
| P3604940 | 2/1986 | Germany . | |
| 3439858 | 4/1986 | Germany . | |
| 3511548 | 10/1986 | Germany | 405/129 |
| 003941358 | 6/1991 | Germany | 405/129 |

OTHER PUBLICATIONS

"Soil Saw™ Bari System" Halliburton NUS Environmental Corp. 1992.

Foreign Patent Office Communication dated May 13, 1994.

International Search Report for PCT/US94/02098.

*Primary Examiner*—Dennis L. Taylor
*Attorney, Agent, or Firm*—Thorpe North & Western

[57] ABSTRACT

An apparatus for constructing a subsurface containment barrier under a waste site disposed in soil is provided. The apparatus uses a reciprocating cutting and barrier forming device which forms a continuous elongate panel through the soil having a defined width. The reciprocating cutting and barrier forming device has multiple jets which eject a high pressure slurry mixture through an arcuate path or transversely across the panel being formed. A horizontal barrier can be formed by overlapping a plurality of such panels. The cutting device and barrier forming device is pulled through the soil by two substantially parallel pulling pipes which are directionally drilled under the waste site. A tractor or other pulling device is attached to the pulling pipes at one end and the cutting and barrier forming device is attached at the other. The tractor pulls the cutting and barrier forming device through the soil under the waste site without intersecting the waste site. A trailing pipe, attached to the cutting and barrier forming device, travels behind one of the pulling pipes. In the formation of an adjacent panel the trailing pipe becomes one of the next pulling pipes. This assures the formation of a continuous barrier.

12 Claims, 25 Drawing Sheets

U.S. PATENT DOCUMENTS

| | | | |
|---|---|---|---|
| 4,047,387 | 9/1977 | Tamura et al. . | |
| 4,057,969 | 11/1977 | Rochmann . | |
| 4,164,082 | 8/1979 | Watson . | |
| 4,230,368 | 10/1980 | Clearly, Jr. . | |
| 4,325,652 | 4/1982 | Kirschke . | |
| 4,491,369 | 1/1985 | Cleary . | |
| 4,615,643 | 10/1986 | Gouvenot . | |
| 4,637,462 | 1/1987 | Grable . | |
| 4,645,382 | 2/1987 | Burkhardt et al. . | |
| 4,696,607 | 9/1987 | Ressi di Cervia | 405/267 |
| 4,697,953 | 10/1987 | Nussbaumer et al. | 405/128 |
| 4,705,431 | 11/1987 | Gadelle et al. | 405/267 |
| 4,746,249 | 5/1988 | Haigh et al. | 405/264 |
| 4,787,777 | 11/1988 | Harmstorf | 405/163 |
| 4,790,688 | 12/1988 | Castor | 405/128 |
| 4,860,544 | 8/1989 | Krieg et al. . | |
| 4,877,358 | 10/1989 | Ressi di Cervia | 405/267 |
| 4,882,067 | 11/1989 | Johnson et al. . | |
| 4,900,196 | 2/1990 | Bridges | 405/267 |
| 4,943,186 | 7/1990 | Van Weezenbeek | 405/73 |
| 4,943,189 | 7/1990 | Verstracten | 405/267 |
| 4,974,425 | 12/1990 | Krieg et al. . | |
| 4,981,399 | 1/1991 | Song | 405/269 |
| 4,983,075 | 1/1991 | Delmas et al. . | |
| 4,997,487 | 3/1991 | Vinson et al. | 106/804 |
| 5,002,431 | 3/1991 | Heymans et al. | 405/128 |
| 5,013,185 | 5/1991 | Taki . | |
| 5,026,215 | 6/1991 | Clarke | 405/266 |
| 5,026,216 | 6/1991 | Koiwa | 405/267 |
| 5,050,386 | 9/1991 | Krieg et al. . | |
| 5,118,230 | 6/1992 | Justice | 405/128 |
| 5,199,816 | 4/1993 | Paurat et al. | 405/129 |
| 5,542,782 | 8/1996 | Carter, Jr. et al. | 405/129 |

PROCESSED SOIL/SLURRY BLEND

HIGH PRESSURE PUMP
GROUT PLANT
9
5
32
30
24
25
72
34
36
6
7
8
4
21
22
23

APPARATUS AND METHOD FOR IN SITU INSTALLATION OF UNDERGROUND CONTAINMENT BARRIERS UNDER CONTAMINATED LANDS

CROSS REFERENCE TO RELATED APPLICATIONS

This is a continuation of application Ser. No. 08/286,837, filed Aug. 5, 1994, now U.S. Pat. No. 5,765,965 which is a continuation-in-part of, prior filed copending U.S. application Ser. No. 08/021,124 entitled "Method and Apparatus for in Situ Installation of Underground Containment Barriers Under Contaminated Lands" filed Feb. 23, 1993, which claims the benefit of, and is a continuation-in-part of, prior filed copending international application Serial No. PCT/US 92/05303 filed Jun. 22, 1992, which designates the U.S. as a State in which patent protection is desired; U.S. application Ser. No. 07/719,863 entitled "Apparatus and Method for Cutting Soil," filed Jun. 24, 1991; U.S. application Ser. No. 07/720,120 entitled "Apparatus and Method for In Situ Construction of a Subsurface Barrier," filed Jun. 24, 1991; and U.S. application Ser. No. 07/774,015 entitled "Methods of Forming Containment Barriers Around Waste Sites," filed Oct. 7, 1991.

BACKGROUND OF THE INVENTION

This invention relates generally to apparatus and methods for cutting soil and constructing subsurface containment barriers in place. Although not necessarily limited to the following, this invention has particular application in simultaneously cutting through a subsurface volume of soil and emplacing a cement slurry to construct in situ a continuous subsurface wall, horizontal panel or basin around and under a hazardous waste site or contaminated land area. The invention generally may be applied in sites of wide-ranging size, from small sites with buried substances or objects that are too hazardous for excavation to large multi-acre sites having contaminated soils. Preferably, encapsulation may take place without drilling into contaminated soils.

There are many automated ways of cutting or excavating soil (soil as used herein refers to any ground or subsurface material to be cut or excavated). For example, there are scooping devices such as backhoes and clamshells; there are drilling devices such as augers; and there are blasting devices such as dynamite and high pressure fluid. Of particular interest to the present invention as used in the aforementioned exemplary application, however, are the devices and techniques used for cutting soil in the environmental remediation industry.

In the environmental remediation industry it is often desirable to form an impermeable underground containment wall to contain contaminants which are present in the soil and water, thereby preventing or impeding further migration of the contaminants. Hazardous waste sites frequently contain hundreds of thousands of cubic yards of materials which represent a long term threat to ground water quality. While on site treatment is a preferred means of eliminating this threat, this is not always feasible. At some sites the cost of physically removing the material and placing an impermeable liner in the vacated cavity is beyond the resources of the site owner. Sites with buried drums, radioactive dusts, or other airborne hazards may become much more dangerous if excavated. There are also cases where vast and deep areas are only slightly contaminated and require only a containment action. Existing containment technologies provide the means to place a wall around the perimeter of a site or to place a cap over a site.

One common method of constructing a side containment wall is by slurry trenching. This method digs a trench and emplaces a bentonite (clay) slurry as the trenching proceeds. Once the trench is dug, the slurry is replaced with concrete or bentonite modified clay. This technique tends to be slow and very costly at depths exceeding 40 feet. This technique is also limited to forming a relatively wide (e.g., 36 inches) wall even though it is only the thin filter cake build up on the wall that acts as a permeability barrier. The difficulties and expense of forming and ensuring that a continuous wall has been formed increases dramatically below a 40 foot depth, a depth below which this type of wall often needs to extend.

Hydraulic soil cutting using jet grouting is another technique used in the environmental remediation industry. Although this is a useful technique, it is not particularly efficient because much of the jet energy is wasted in passing through fluid before impacting the soil. This causes low production rates, and the cost of the process tends to be higher than for mechanical methods. In most forms of jet grouting it is also difficult to verify that a continuous wall has been formed because the wall is formed from a series of overlapping columns rather than in a continuous fashion. This makes it difficult to form containment walls deeper than 40 feet using this technique.

For forming deeper walls, a four-auger drill system and a clamshell digging tool have been used. The four-auger system is very expensive and slow, capable of forming only 20 to 30 linear feet of wall per day. Clamshell excavating techniques are also very slow.

The foregoing techniques typically provide vertical walls. They do not typically provide bottom barriers under the site, but rather they rely on having a natural layer of low permeability soil (e.g., impermeable rock or clay) underlying the waste site to complete the containment envelope. We are, however, aware of two prior ways of creating an underlying barrier.

Jet grouting technology as practiced by Halliburton Services of Duncan, Okla. allows a bottom to be installed by drilling vertical holes and using the jet grouting process to form overlapping disks of treated material at the bottom elevation. Just as with side wall jet grouting referred to above, it is difficult to verify the integrity of the resulting underlying barrier. Another technique uses horizontal drilled holes with liquid nitrogen freezing. This has quality control problems and requires continuous maintenance. Near surface horizontal pancake fracturing or "block heaving" is another technique which seems to work, but it is difficult to control quality with this technique.

For very large sites containing enormous volumes of waste such as are found in the mining industry for example, the primary, if not the only, suitable technique of waste containment of which we are aware is to physically move the waste onto a synthetic liner and place a cap over it. This has detrimental cost and environmental impact shortcomings as referred to above.

Although the foregoing techniques may be effective in particular applications, they have at least the shortcomings noted above. What is lacking is a cost effective technique for cutting soil to facilitate at least the deep construction of contaminated soil impoundment walls and subsurface containment barriers having high structural integrity around and under waste sites without moving the waste.

SUMMARY OF THE INVENTION

The present invention overcomes the above-noted and other shortcomings of the prior art by providing a novel and improved apparatus and method for cutting soil for in situ construction of impoundment walls and/or subsurface containment barriers. The apparatus and methods enable the faster, more efficient and more economical construction of subsurface walls, such as contaminated soil impoundment walls and containment barriers which can extend well below 40 feet into the earth.

In a preferred embodiment, the present invention utilizes both hydraulic and mechanical excavation techniques, but either one can be used alone. This preferred embodiment includes a long beam that is joined by a hydraulic reciprocating member to a pivot joint on the frame of a crane. Within the beam is a tubular conduit which conveys high pressure slurry from an external mixing/pumping unit. At least a portion of the conduit has a plurality of small holes or jet ports which direct the energy of the high pressure slurry toward the face of the soil to be cut. In this particular embodiment the conduit is reciprocated lengthwise so that the jets of slurry contact all the soil in the path of each stroke.

The beam of this preferred embodiment is dense enough so that it is not buoyant in any fluid or loose mixture it might encounter. Accordingly, as each stroke of the conduit is completed, the conduit's weight causes it to sink or fall downward and forward to position itself automatically for the next cut. As this occurs, the crane moves along the ground so that the advancing conduit is pulled through an extended volume of soil which is cut as the apparatus advances. These actions maintain the jets positioned right at the face of the soil to be cut; therefore, the pressurized fluid exiting the jets does not have to pass through much if any intervening fluid before it impacts the soil. Thus, little energy is lost prior to impacting the soil.

In a preferred embodiment for forming a containment barrier, the present invention uses reciprocating high pressure jets of hardening fluid to cut through the soil along a path from one side of a waste site to another without passing through the waste material itself. As the fluid cuts the soil, it also mixes with the soil and subsequently hardens; thus, the high pressure jets, or jet streams, provide both the necessary energy and material for disrupting the soil and forming the barrier. The path traversed by the reciprocated jets is moved transversely so that they pass under the site from one end of the site to the other. As a result, an impermeable containment barrier sheet in the nature of a basin is formed in situ both around and under the waste site. The resulting barrier should have high structural integrity because it is formed in a continuous manner. This technique should be cost effective for constructing in situ surface barriers or partial containment barriers which prevent underground contamination in moving in a particular direction.

The present invention also provides a method of cutting soil, comprising: generating cutting action along an extended locus of soil; and advancing the cutting action along a descending locus of the soil in response to gravity. Generating cutting action can include individually or in combination pumping a fluid through a conduit having a plurality of ports through which the fluid is ejected into the soil adjacent which the conduit is disposed, reciprocating the conduit while pumping the fluid, or reciprocating along the extended locus of soil a beam supporting the conduit. The method can also comprise advancing the cutting action horizontally from the descending locus.

The apparatus of the present invention can be used for constructing a subsurface basin in soil. This apparatus comprises means for creating in situ a continuous cross-sectional portion of the subsurface basin. The means includes a conduit adapted to be disposed in the soil along at least a portion of a locus extending into the soil from two locations at the upper surface of the soil and lying across a cross-sectional area of the basin. The conduit has at least one opening for ejecting fluid under pressure into the soil. The apparatus further comprises means for moving the conduit transversely to the locus.

The present invention provides an apparatus particularly suitable for constructing a containment barrier around and under a waste site disposed in soil, which apparatus comprises: means for cutting a continuous elongate trench through the soil under the waste site and preferably from one side of the waste site to another side of the waste site without intersecting the waste site; means for displacing the means for cutting through the soil so that the elongate trench is extended transversely to itself across a continuum along and under the waste site; and means for placing a barrier material in the transversely extended elongate trench.

The present invention also provides a method of constructing a subsurface barrier, which method comprises: (a) cutting into soil along a continuous locus extending into the soil from two locations on the surface of the soil; (b) simultaneous with step (a), emplacing a fluidized barrier material in the cut soil; and (c) repeating steps (a) and (b) throughout a continuum between a first such locus and a second such locus.

The present invention further provides an apparatus for constructing a substantially horizontal subsurface containment barrier under a waste site. This apparatus uses a reciprocating cutting and barrier forming device which forms a continuous elongate panel through the soil having a defined width. The reciprocating cutting and barrier forming device has multiple jets which eject a high pressure slurry mixture through an arcuate path or transversely across the panel being formed. A continuous horizontal barrier can be formed by overlapping a plurality of such panels. The cutting device and barrier forming device is pulled through the soil by two substantially parallel pulling pipes which are directionally drilled under the waste site. A pulling device, such as a tractor, is attached to the pulling pipes at one end and the cutting and barrier forming device is attached at the other. The tractor pulls the cutting and barrier forming device through the soil under the waste site without intersecting the waste site.

In the preferred embodiment of the apparatus for constructing substantially horizontal panels, a trailing pipe is attached to the cutting and barrier forming device. The trailing pipe travels behind one of the pulling pipes. In the formation of an adjacent panel the trailing pipe becomes one of the next pulling pipes. This assures the formation of a continuous barrier.

Therefore, from the foregoing, it is a general object of the present invention to provide a novel and improved apparatus and method for cutting soil for constructing in situ impoundment walls and containment barriers. Other and further objects, features and advantages of the present invention will be readily apparent to those skilled in the art when the following description of the preferred embodiments is read in conjunction with the accompanying drawings.

DETAILED DESCRIPTION OF THE INVENTION

Figure 1:
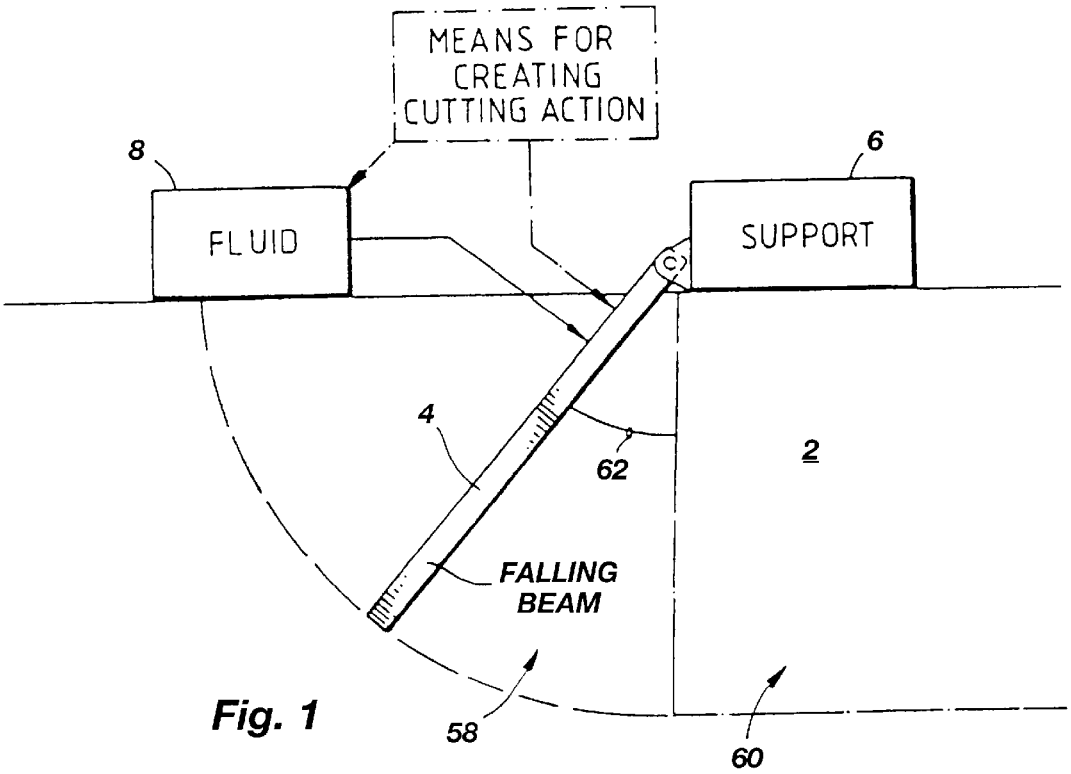
FIG. 1 is a schematic diagram of a preferred embodiment of the present invention.

Referring to FIG. 1, the present invention broadly includes means for abutting soil 2 in response to gravity, and means, connected to the means for abutting, for creating a cutting action against the abutted soil. The means for abutting of the embodiment depicted in FIG. 1 includes a falling beam 4 which is shown pivotally connected to a support 6 on the surface of the soil 2; however, the means for abutting can be implemented in other ways as will be further referred to hereinbelow. The means for creating a cutting action can also be implemented in any of various different ways. One of these includes a source of pressurized fluid 8 represented in FIG. 1. Presently contemplated implementations of these elements will be further described hereinbelow.

Figure 2:
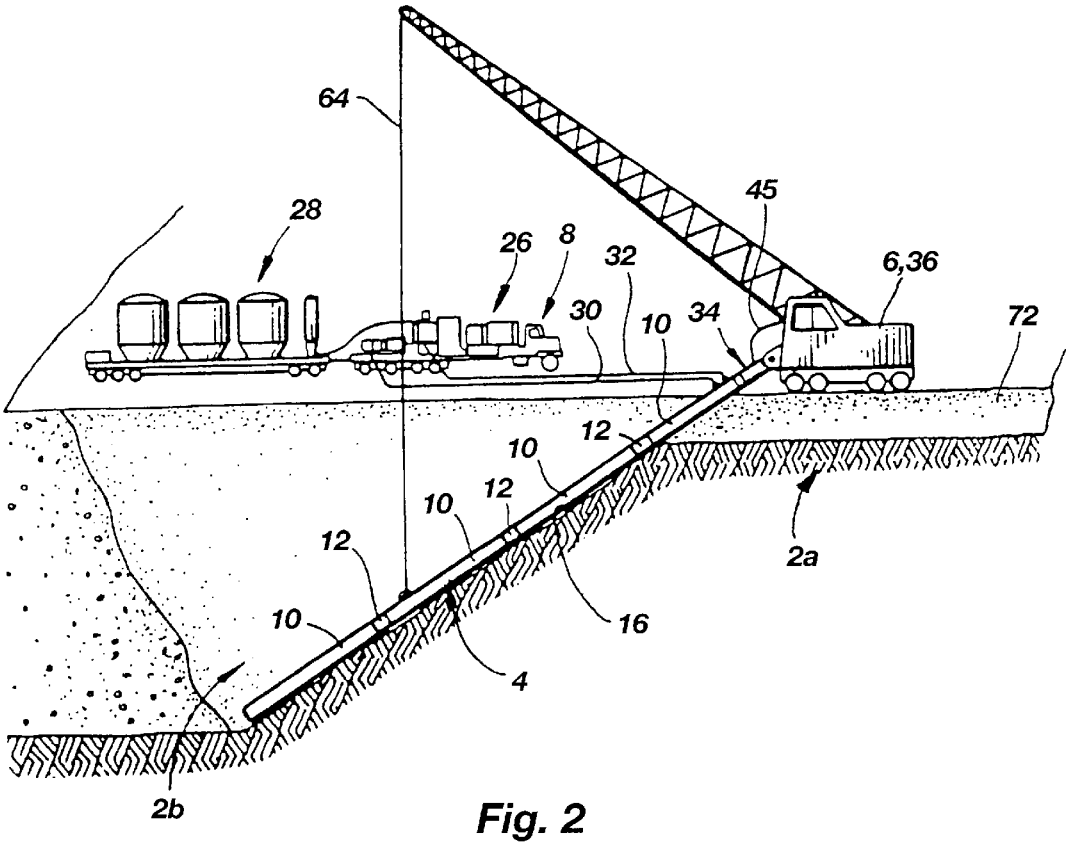
FIG. 2 is an illustration of a particular implementation of the apparatus represented in FIG. 1.

The equipment shown in FIG. 2 is a particular implementation of the apparatus represented in FIG. 1. The beam 4

Figure 3:
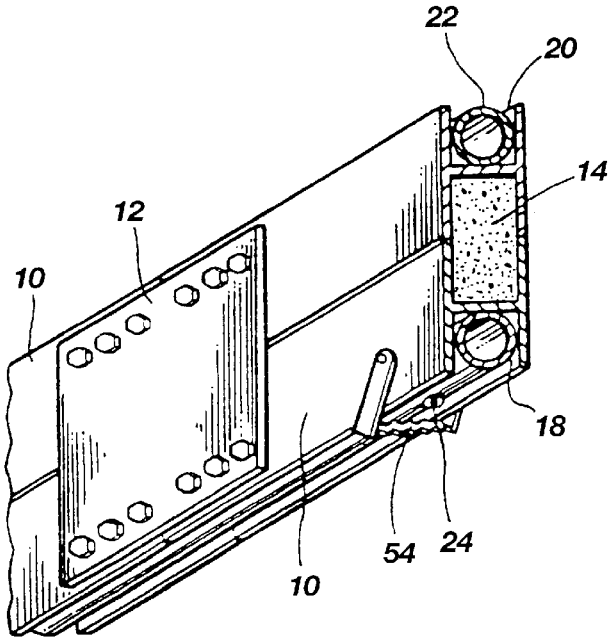
FIG. 3 is a perspective view of a preferred embodiment of a portion of a beam and conduit of the particular implementation shown in FIG. 2.

(see also FIG. 3) is a linear series of interconnected H-shaped steel members 10. Steel plates 12 are bolted to adjacent members to hold them together. This permits on-site fabrication of selected lengths of beams. The members 10 are intrinsically heavy enough or are filled in a central cavity with a weight-increasing material (e.g., high density concrete 14 as illustrated in FIG. 3) to ensure that the beam 4 automatically sinks in response to gravity as the soil 2 is cut. More generally, the beam 4 is constructed so that it is not buoyant in any fluid or loose mixture it encounters as the soil 2 is cut in accordance with the present invention. FIG. 2 shows the beam 4 adjacent face 16 of initially uncut soil 2*a* after the apparatus has passed through cut soil 2*b* due to the cutting action and automatic advancing of the present invention.

The beam 4 of the FIG. 2 embodiment has opposed channels 18, 20 (see FIG. 3). A conduit 22 of the means for creating a cutting action is supported by the beam 4 in these channels as show in FIG. 3. The conduit 22 includes tubular members having a plurality of small (e.g., about 2 to 6 millimeter) ports or jets 24 along the portion of the conduit 22 facing the soil 2. The conduit 22 conducts fluid under high pressure from the source 8 to the jets 24 so that the fluid is ejected from the jets at high velocity to cut the soil impacted by the fluid. An example of a particular fluid source 8 includes a known type of cement mixing and pumping truck 26 receiving bulk materials in a known manner from a trailer 28 (such a truck and trailer can be provided by Halliburton Services of Duncan, Okla.). A fluid circulating circuit is formed by connecting the two ends of the conduit 22 to two hoses 30, 32 from the truck 26 as depicted in FIG. 2.

When the fluid pumped into the soil is a cement slurry, a continuous subsurface wall is constructed throughout the traversed volume simultaneously with the cutting action. That is, as the cement slurry exits the ports or jets 24, it cuts the soil and mixes with it, but this mixture is retained in place by the adjacent uncut soil outside the path of the beam 4. Upon curing or hardening of this mixture, the continuous subsurface wall provides a containment barrier such as for contaminated material buried in the adjacent uncut soil.

The high pressure fluid alone can be sufficient to produce enough cutting action for the beam 4 and conduit 22 to advance into the soil 2. It is also contemplated that additional means can be used. For example, the beam 4 could be vibrated or other mechanical techniques could be used to generate or facilitate the forward motion of a thin subsurface member. The preferred embodiments of the present invention include means for reciprocating the conduit 22 so that the jets 24 are moved back and forth across the face 16 of the soil to be cut. This means can be implemented either to reciprocate both the beam 4 and the supported conduit 22 relative to the soil 2 or to reciprocate the conduit 22 relative to both the beam 4 and the soil 2. An illustration of the former is shown in FIGS. 2, 4 and 5, and an illustration of the latter is shown in FIG. 7.

Figure 4:
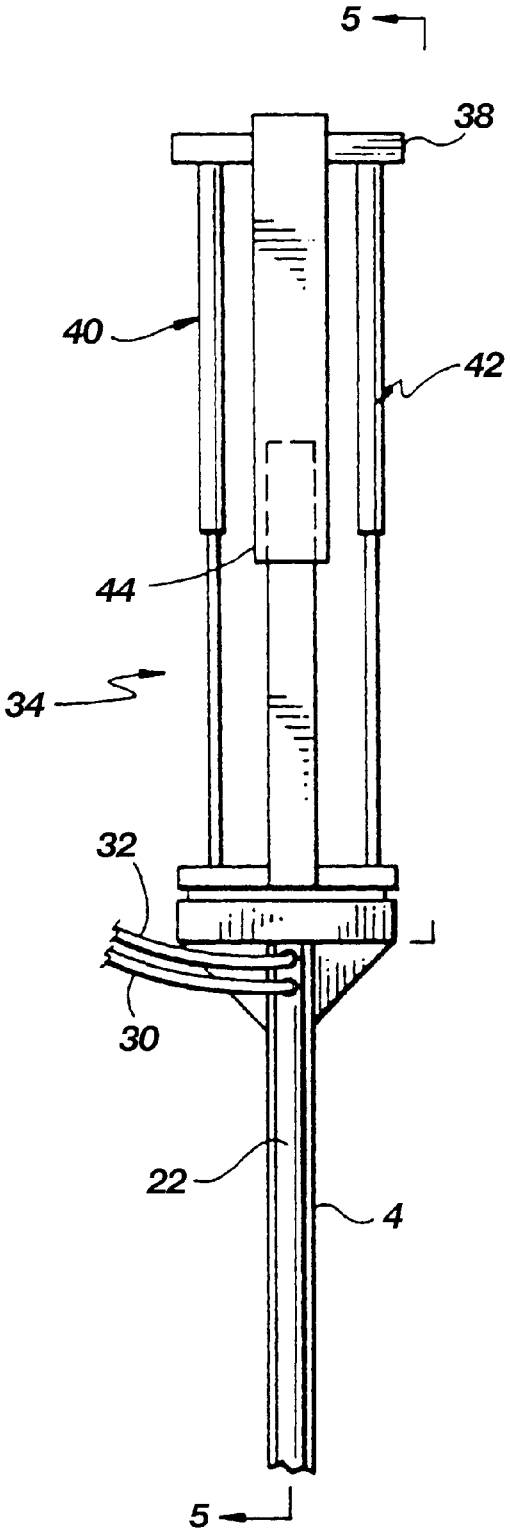
FIG. 4 is a side view of hydraulic cylinders connected to the beam for reciprocating the beam and the conduit mounted on the beam.
Figure 5:
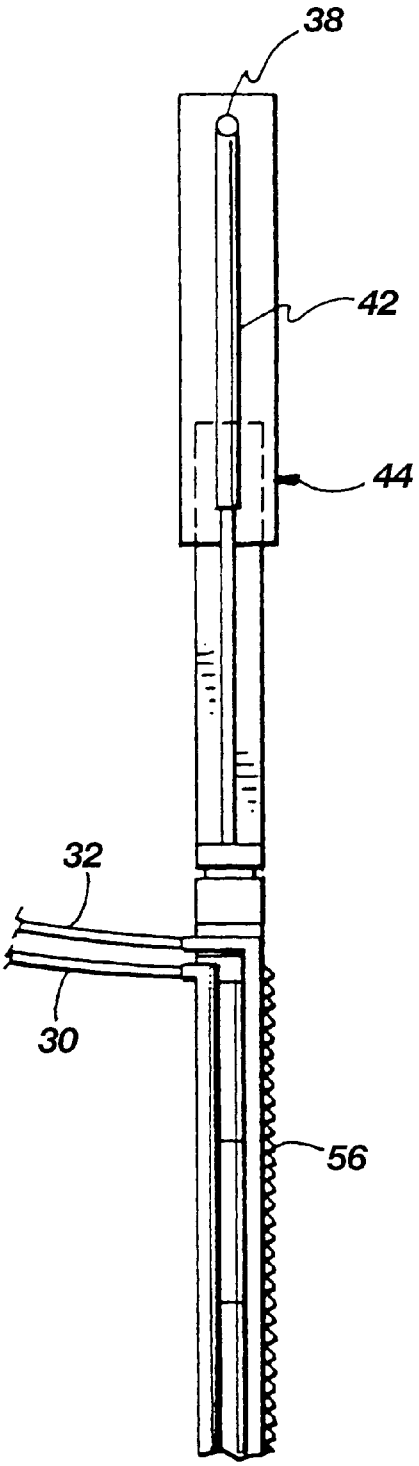
FIG. 5 is another side view, partially in section as marked by line 5—5 in FIG. 4, of the hydraulic cylinders shown in FIG. 4.

The reciprocating means of FIGS. 2, 4 and 5 includes a hydraulic cylinder assembly 34 having one end connected to the beam 4 and having its other end connected to the frame of a crane 36 embodying the support 6. These connections can be by any suitable means known in the art, but in the illustrated embodiment the end connected to the crane 36 is connected by means of a trunnion 38. The hydraulic assembly 34 includes two hydraulic cylinders 40, 42 and a centering box slide with wear plates collectively marked with the reference numeral 44. The cylinders 40, 42 are operated from the cab of the crane 36 through hydraulic control lines 45. This control extends and retracts the cylinders through whatever length of stroke for which the cylinders are designed (e.g., 5 feet to 20 feet). The beam 4 and its mounted conduit 22 follow this movement to stroke along the face 16 of the adjacent soil to be cut, thus ensuring complete coverage of the uncut soil 2*a* by the jets 24 and their ejected high pressure fluid.

Figure 7:
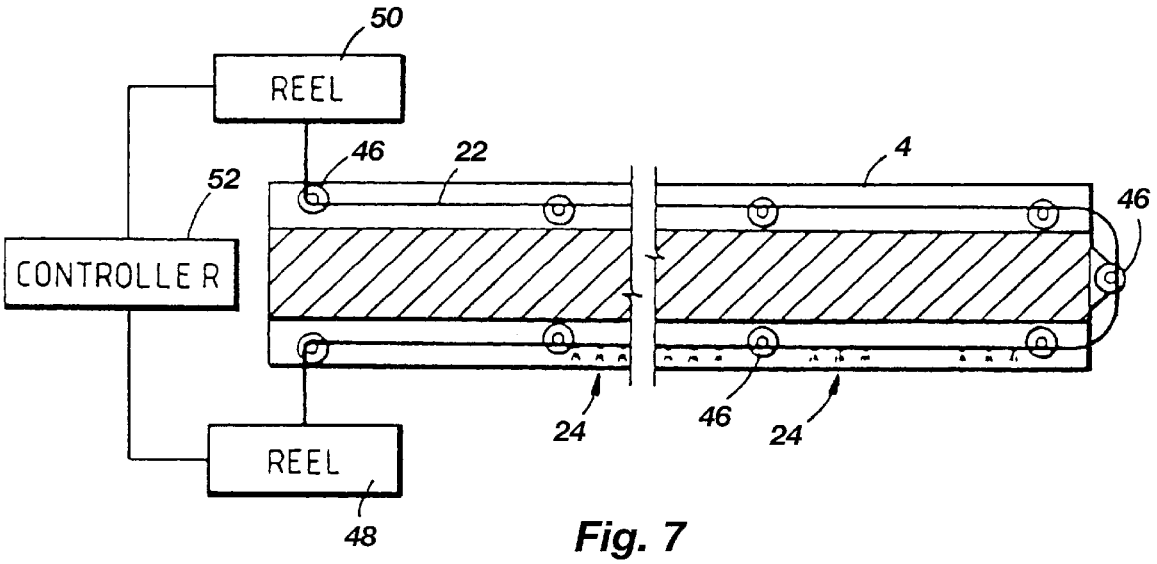
FIG. 7 is a schematic illustration of a beam and conduit assembly wherein only the conduit is reciprocated as the beam and conduit advance through the soil.

An alternative to the foregoing embodiment of the reciprocating means is illustrated in FIG. 7. In FIG. 7, the beam 4 is not reciprocated (but it is still free to pivot where it is attached to the support 6), but the conduit 22 and its jets 24 are moved back and forth along the beam 4 and the face 16 of the adjacent soil to be cut. The conduit 22 can be mounted on pulleys 46 to facilitate its movement. The ends of the conduit 22 are mounted on reels 48, 50 which are operated by a controller 52. The controller 52 can be implemented in a known manner to synchronize the reels 48, 50 and the back and forth movement of the conduit 22. Groups of jets 24 are spaced to accommodate the stroke length of the back and forth movement so that the entire soil area adjacent the length of the beam 4 is covered during each reciprocation. Fluid is communicated into the conduit 22 by the hoses 30, 32 connected in a known manner with the ends of the conduit 22 on the reels 48, 50.

The embodiment illustrated in FIG. 7 can be implemented in other ways. Steel or other suitable material cables connected to the conduit 22 can be mounted on the reels 48, 50 so that the reels wind and unwind the cables to move the conduit 22 rather than winding and unwinding the conduit ends directly. In an alternative embodiment, the high pressure fluid can be provided through a flexible hose contained within the interior cavity of the beam 4 and filled with a dense fluid to allow movement of the hose and give sufficient weight to the beam 4 to prevent it from having buoyancy.

The means for creating cutting action of the embodiment shown in FIGS. 2–5 further includes one or more mechanical cutter members connected to the beam 4. One type is shown in FIG. 3. This type includes a plurality of serrated blades 54 pivotally connected to the beam 4. Another type is illustrated in FIGS. 2 and 5. This type includes a plurality of saw teeth 56 connected to the beam 4. As used herein, "connected to" may also mean being formed as an integral part of the beam 4 or other object. Regardless of the particular manner in which the mechanical cutter members are implemented, they are preferably disposed to cut a path at least slightly wider than the main body of the beam 4 to facilitate movement of the beam 4 through the cut soil.

As previously described, movement of the beam 4 occurs at least in response to gravity as the beam 4 sinks into the cut, fluidized soil 2*b*. In the illustrated embodiment, the beam 4 is also moved by the support 6 shown in FIG. 2 specifically implemented by a conventional crane 36. As the crane 36 moves to the right as viewed in FIG. 2, it advances the beam 4 and the conduit 22. This movement may occur even as the beam 4 and/or conduit 22 are being reciprocated or are falling in response to gravity. Referring to FIG. 1, gravity can move the beam and conduit through sector 58 of the soil 2, and a mobile support 6 can move them through the volume represented by the area 60. In practice the beam 4 and conduit 22 typically will be transported by the support 6 so that an acute angle 62 (e.g., 45 degrees) to vertical is maintained.

In the FIG. 2 embodiment, a line 64 from the crane 36 implementing the support 6 is connected to the beam 4. The line 64 is typically slack during operation of the apparatus, but it can be used to lift the beam and conduit assembly if desired.

Although the support 6 is used in the preferred embodiments described herein, it is contemplated that it is not required. That is, it is contemplated that the beam 4 and conduit 22 can be used without the support 6 when sufficient cutting action can be obtained with the high pressure fluid alone. For example, a beam of desired length can be laid along the ground and high pressure fluid pumped through the ports of the conduit to create the cutting action. As this occurs, the beam and conduit will sink. If the fluid is a cement slurry, for example, a wall will be constructed above the sinking beam and conduit. When the beam and the conduit are at the desired depth, pumping is stopped and the hoses extending into the ground to the ends of the conduit are cut or otherwise disconnected. The beam and the conduit are left in the soil at the bottom of the wall.

It is to be noted that "beam" as used in the foregoing and other embodiments described herein can in general be anything which advances into the cut soil to remain adjacent the face of initially uncut soil in response to gravity. This includes the previously described H-beam structure, but it includes other embodiments as well. It is contemplated that the "beam" can be implemented by a flexible member, such as a hose, which is made rigid by the fluid pumped through it. The material of the flexible member and the composition of the fluid should be such that their combined weight is sufficient to make this form of beam sink or advance in the needed manner. This latter type of beam would thus implement both the beam and the conduit. Another form of initially flexible beam can include concentric hoses or members. The inner structure would be filled with any needed weight-increasing material, and the annulus formed between the inner and outer members would conduct the high pressure fluid to be ejected through the ports or jets in the outer member.

Figure 6:
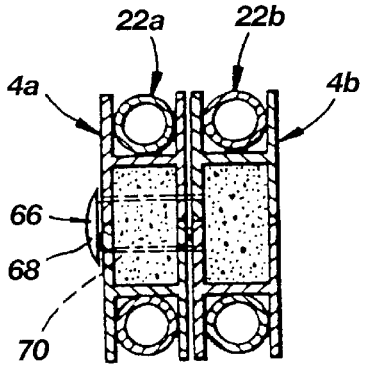
FIG. 6 is a cross-sectional illustration of a multiple beam assembly which can be used in the apparatus illustrated in FIG. 1.

Additionally, a "beam" as used herein can include multiple components. This refers not only to multiple pieces as the segments 10 and plates 12 shown in FIG. 3, but also to multiple overall beam structures. For example, two beam structures are represented in FIG. 6. Each of these is similar to the beam 4 of the embodiment described hereinabove with reference to FIGS. 2–5. The two beams 4*a*, 4*b* of FIG. 6 are connected to respective reciprocating means at the surface (not shown, but these can be the same as the hydraulic cylinder assembly shown in FIGS. 4 and 5). The lower, free ends of the beams 4*a*, 4*b* are linked by a sliding link 66 to prevent these lower ends from moving laterally away from each other as the beams advance into the soil. The illustrated link 66 is implemented by a pin 68 connected to the beam 4*b* and passing through a slot 70 formed in the beam 4*a*. This construction is contemplated to be analogous to the oppositely reciprocated blades of an electric knife. Additional beams can be used. The number is contemplated to depend on the desired width of the cut to be made (e.g., 12 inches or greater).

Referring to FIG. 2, the operation of the embodiment shown therein will be described. The operation of other embodiments described hereinabove will be readily apparent from the following description as well as from the descriptions given hereinabove.

The apparatus shown in FIG. 2 can be transported to a site in modular sections, such as 40 foot H-shaped beam sections and suitable lengths of conduit sections. The beam and conduit can be assembled at the site to the desired length (e.g., 40–150 feet as can be suitable for a contaminated material containment wall). A shallow (e.g., 31 inch deep) pilot trench 72 is cut in a known manner, and the assembled beam and conduit are laid in it. The fluid is made and pumped from the vehicles 26, 28, and the fluid is injected into the soil through the jets 24. The beam 4 and/or the conduit 22 are reciprocated. As this occurs, the beam 4 and the conduit 22 descend as the soil beneath them is liquefied. The crane 36 moves to advance the subsurface structure. If the fluid is a cement slurry, the liquefied soil will harden to form a wall, such as a low permeability cut off wall for impounding contaminated subsurface material. Any suitable fluid can be used. For example, various admixes can be used to impart plasticity or chemical resistance to the final material. Specifically regarding material for constructing a subsurface containment wall, examples of fluids include cement slurry, latex polymer cement, bentonite clay slurry, hot wax, hot asphalt, hot polyethylene or gelled water. Other things can be emplaced with the present invention, such as a drain pipe for use as an intercepter of leaching contaminants.

The high pressure water, mud, cement slurry or other fluid is ejected from the jets 24 so that the resultant kinetic energy disrupts and erodes the soil into finely divided particles which are intimately mixed with the jetted fluid. The jetted fluid does not have to pass through much intervening fluid or material in the preferred embodiments so that little of the kinetic energy is lost before it impacts the soil. This is accomplished by the continuous advancement of the subsurface structure in response to gravity whereby the beam 4 and the conduit 22 are maintained against the face 16 of the initially uncut soil 2*a*. In a particular implementation of the preferred embodiment, the jets 24 are kept within about 4 inches of the face 16. This closeness is important because the kinetic energy of the fluid diminishes roughly proportional to the square of the distance in inches between the jets and the soil.

Once a desired length of subsurface volume has been cut, a turn such as a right angle corner can be made by allowing the subsurface structure to fall to a near vertical position or by removing the subsurface structure from the ground and intersecting the previous cut.

The method of the foregoing preferred embodiments broadly comprises generating cutting action along an extended locus of soil; and advancing the cutting action along a descending locus of the soil in response to gravity. Generating cutting action includes pumping a fluid through the conduit 22 having the plurality of ports 24 through which the fluid is ejected for injection into the soil adjacent which the conduit is disposed. If the fluid is a cement slurry, for example, the fluid injected into the soil forms a wall throughout the locus traversed by the cutting action. As the fluid leaves the jets, its high pressure is converted to kinetic energy to cut the soil and mix with the resulting particles to produce a fluidized mixture. The cutting action is achieved by reciprocating the jets or the entire conduit 22 while pumping the fluid. Reciprocating the conduit can be accomplished by moving the beam 4 with the conduit 22 or by moving the conduit 22 relative to the beam 4. In either case, the ports 24 of the conduit 22 are moved along the locus of soil to be cut so that the ejected fluid impacts across the initially uncut face 16 of the soil.

A new initially uncut face 16 is continually encountered because the method of the foregoing preferred embodiments includes the aforementioned step of advancing the cutting action. In these preferred embodiments this includes pivoting the beam 4 through a sector which can be part or all of the sector 58 depicted in FIG. 1. The beam 4 pivots at the point or points of connection to the support 6, and it pivots from its initial placement along a length of soil such as in the pilot trench 66. Pivoting occurs downwardly from this position in automatic response to gravity as the underlying soil is cut and fluidized. In the preferred embodiments, the method also includes advancing the cutting action horizontally from the descending locus and sector 58, such as by pulling the beam 4 horizontally with the crane 36.

The following examples provide a comparison between a conventional jet grouting technique and the invention of FIGS. 1–7 as a means of estimating the production rate of such invention.

EXAMPLE I

Jet grouting data supplied by Halliburton Services indicate that a pair of 2 millimeter diameter jets on a rotating 2 inch diameter shaft can produce a 12 inch diameter column at a rate of 2 seconds of dwell for each 1.5 vertical inches formed. This is based on jetting cement slurry at 5000 pounds per square inch at 10 gallons per minute and 35 hydraulic horsepower per jet. In each seconds the pair of jets erodes about 165 cubic inches of soil. Each single jet erodes about 41 cubic inches of soil per second or about 86 cubic feet of soil per hour per jet. This rate of production is very conservative and is based on hard soils.

EXAMPLE II

The configuration of the present invention studied included a 100 foot beam with a 20 foot stroke and 17 jets (each having a 2 millimeter diameter as in Example I). With a 600 horsepower pumping unit, a production rate of about 1460 cubic feet of soil per hour can be obtained. For a 6 inch wide by 60 foot deep trench cut, this would traverse about 49 linear feet per hour. A 12 inch thick wall would progress about 24 feet in an hour. This does not include the mechanical cutting component of the invention which is contemplated to enhance at least slightly the process rate. The mechanical lift and cut system is estimated to require a 100 horsepower hydraulic power unit to reciprocate the beam and 6 mechanical cutters at a minimum rate of 3 strokes per minute (1 foot per second vertical travel speed). The reciprocation speed should be fast enough to limit the jet penetration to 4 inches per pass for preferred efficiency. The jets would be discharging 1364 cubic feet of cement slurry per hour, or 0.73 cubic feet of slurry for every cubic foot of trench. In soft soils this volume would be reduced due to the faster cutting rate. Since most soils contain only about 30 percent void space, it is expected that the trench would fill and overflow a volume of material equal to half the trench volume. In at least some projects, this waste slurry could be pumped to a holding area and allowed to harden as cap or fill material. In cases where the slurry is potentially contaminated with hazardous wastes it would be "conditioned" and filtered by screen and hydrocyclone units to remove solids larger than 0.1 millimeter and recirculated to the jets along with fresh cement slurry. Equipment capable of this is routine in the drilling fluids industry.

At the productivity rates described above, the present invention is capable of producing about 1460 square feet of 12 inch thick by 60 feet deep cutoff wall per hour. Equipment which may be required to accomplish this includes: dual Halliburton Services HT-400 RCM pump truck (4.7 bpm at 5000 psi); 1400 cu. ft. bulk cement storage bin; drilling mud desander/desilter unit; office/decontamination trailer; 60 ton crane; 100 foot long jetting beam (19000 lbs.); 2 inch diameter×5000 psi jetting hose (200 feet); and 3 mountain mover hydraulic power units.

The foregoing provides a technique by which discrete walls and/or containment barriers can be constructed. In the preferred embodiment a complete containment barrier is constructed both around and under a selected site during a single continuous operation.

Figure 8:
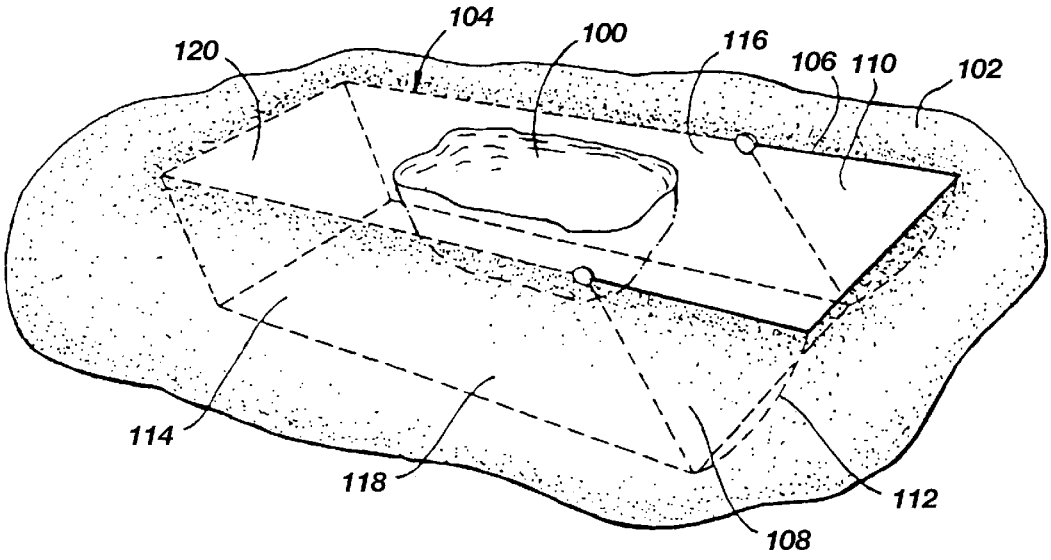
FIG. 8 is a schematic perspective view of a containment barrier basin of a type contemplated to be formed with the present invention.

Referring to FIG. 8, a contaminated waste site 100, for example, exists in the ground having surface 102. Surrounding the site 100 prior to use of the present invention is whatever substance or substances exist or have been emplaced in the ground, which substance or substances are encompassed by the term "soil" as used herein. Once the present invention has been used at the site 100, a barrier or basin 104 will extend around and under the site 100 within the soil. The barrier 104 can have various configurations, such as, without limitation, the five-sided shape shown in FIG. 8 or a continuously curved bowl-like shape. A cap above the site can be added so that the site is thus fully encased.

The apparatus by which the barrier 104 can be constructed comprises means for cutting a continuous elongate trench through the soil from one side of the site 100 to another side of the site 100 without intersecting the site 100. It also comprises means for displacing the means for cutting through the soil so that the elongate trench is extended transversely to itself across a continuum along and under the site 100. The apparatus further comprises means for placing a barrier material in the transversely extended elongate trench. In the FIG. 8 illustration, an initial elongate trench is represented by the solid-line rectilinear shape 106. The means for creating in situ this initial continuous cross-sectional portion of the barrier 104 is then moved to transversely extend the initial elongate trench continuously through the volume marked by sectors 108, 110 and partial cylinder 112, through the volume of side and bottom planar regions 114, 116, 118, and through the volume of end planar region 120.

Figure 9:
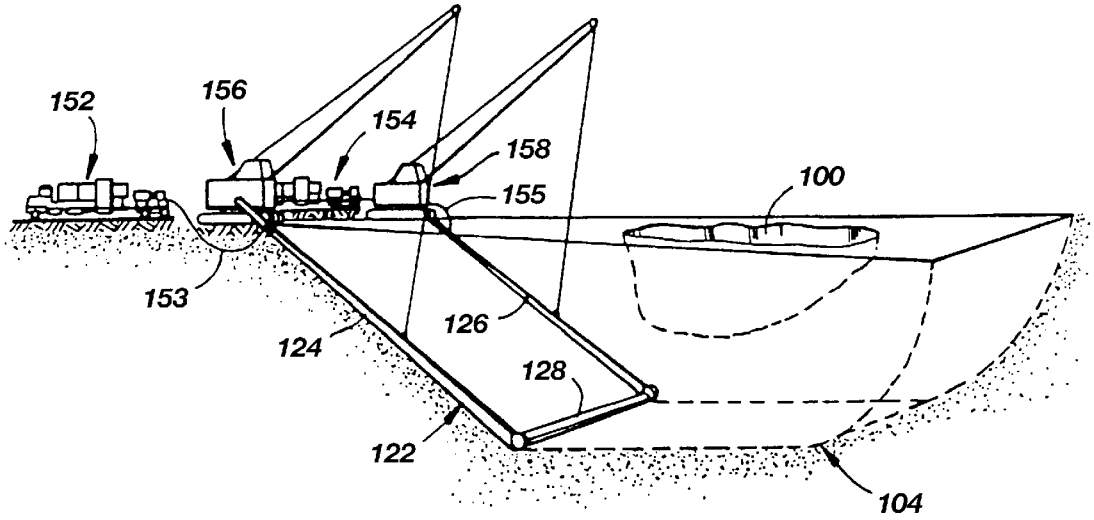
FIG. 9 is an illustration of a particular implementation of the present invention suitable for constructing the barrier illustrated in FIG. 8.
Figure 10:
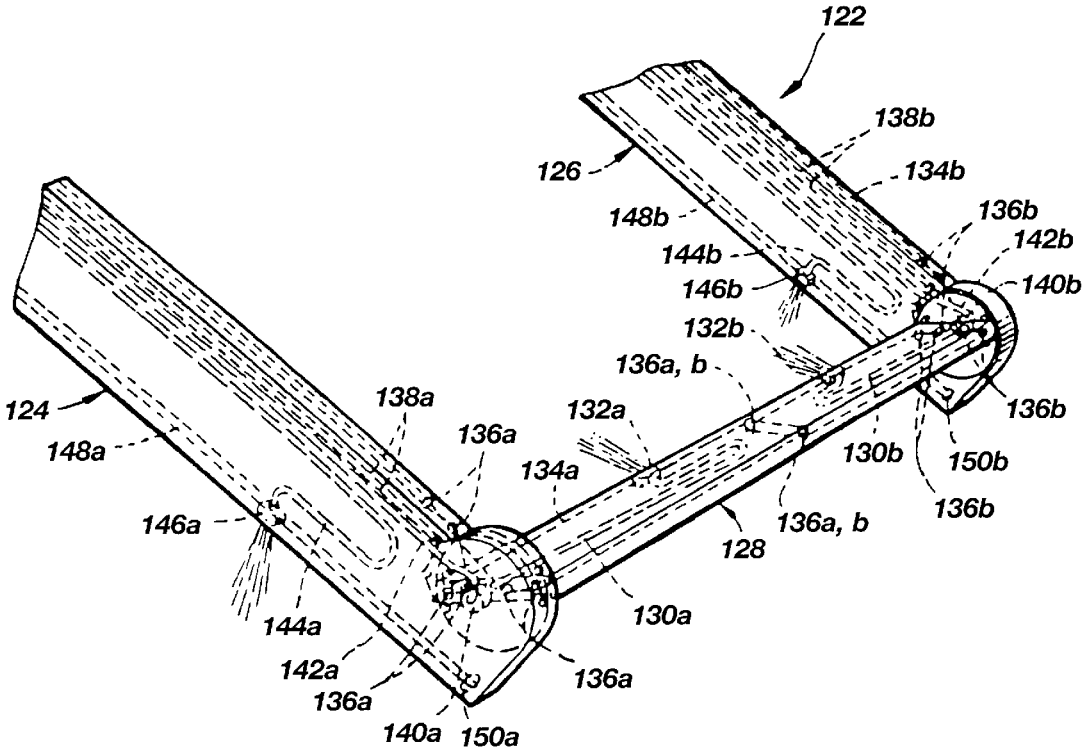
FIG. 10 is a perspective view of a preferred embodiment of a fluid jetting and support structure more generally shown in FIG. 9.

An apparatus for constructing the shape of barrier 104 shown in FIG. 8 is illustrated in FIGS. 9 and 10. The apparatus of FIGS. 9 and 10 includes a rectilinearly arced support frame assembly 122 made of two parallel side support members 124, 126 and a cross support member 128 connected between and perpendicular to the lower ends of the two side support members 124, 126; however, it is contemplated that other geometries and relative positioning between the side support members and the cross member can be used. The side support members 124, 126 are disposed on opposite sides of the site 100, but are of the same type as described above with regard to FIGS. 1–7; however, the previously described embodiment wherein the conduit or jets are moved relative to the supporting beam is preferred because of the presence of the cross member 128 in the present invention. The support members have sufficient density so that the complete frame subassembly of the invention automatically advances into cut soil in response to gravity.

Referring to FIG. 10, the cross member 128 is preferably a cutting wing which carries a high pressure conduit 130 with at least one jet outlet 132 directed towards the leading edge of the wing (i.e., the side of the cross member 128 which first encounters soil to be cut). As shown in FIG. 10, the cross member 128 carries two such conduits 130*a*, 130*b* (further references will give only the numeral, but the different components on opposite sides of the assembly 122 are differentiated in FIG. 10 by either "a" or "b" suffixes). Each conduit 130 has a respective port 132 which can be reciprocated along a respective half of the length of the cross member 128; but other configurations can be used (e.g., a single outlet for the entire cross member or a series of small jets disposed in a special pattern that is designed to induce a rotational motion at the cutting face for obtaining more effective cutting through hard soils wherein small fragments of rocks break off and act as cutting tools at the face of the cut).

The conduits 130 and outlets 132 are reciprocated by appropriately controlling a respective cable 134 which extends from the surface, along the respective side support member, around suitable sleeves or pulleys 136 to the respective outlet and then back through a similar route. Each illustrated cable 134 includes two ends at the surface, one for pulling an outlet in one direction and the other for pulling the outlet in the opposite direction. This type of control is similar to that used in aircraft control systems; however, it is contemplated that other types of control (e.g., hydraulic) can be used.

The cross member or wing 128 is rotationally connected to the side support members 124, 126 so that the angle of attack of the wing can be controlled between vertical and horizontal by one or more cables 138 extending from the surface, along the respective side support member, to a respective end of the wing member. Each cable 138 can be continuous or split and connected to provide bidirectional control at each end of the wing member, or each cable can be connected to its respective end of the wing member to provide only unidirectional control with one cable operating the wing member in one direction and the other cable operating the cable in the opposite direction. It is contemplated that other types (e.g., hydraulic) of control devices can be used.

The cross member 128 is mechanically connected at each end by a trunnion having an internal high pressure fluid swivel, generally identified by the reference numeral 140 in FIG. 10. Each swivel 140 connects to a conduit 142 extending down the respective side support member 124, 126 and to the respective conduit 130 carried on the cross member 128 as shown in FIG. 10.

Also carried on each side support member is a respective conduit 144 connected at its lower end to an outlet 146. The position of the respective outlet 146 is controlled from the surface using a respective cable 148 extending in two directions from the outlet 146 as shown in FIG. 10. One portion of each cable 148 extends directly to the surface and the other portion of each cable 148 turns around a sleeve or pulley 150 at the outward end of the respective side support member.

The conduit portions in the preferred embodiment are flexible high pressure hoses which are fully contained in the respective side support member or cross member. Each outlet 132, 146 preferably provides a jetting orifice for ejecting at high speed a fluid pumped into the conduit under pressure.

Each of the aforementioned conduits is a part of the overall conduit means of the illustrated embodiment. This conduit means is common to both the trench cutting means and the barrier material placing means referred to above because the conduit means conducts the fluidized barrier material under pressure so that at least a portion of the material exits the one or more ports to cut and simultaneously mix with the soil, after which the mixed material hardens to provide the walls of the containment vessel.

The foregoing assembly operates in the same manner as the apparatus described with reference to FIGS. 1–7 in that fluid is pumped into the conduit system and ejected from the various jetting ports at high speed to cut and mix with the soil. As this occurs, the frame 122 falls into the soil in response to gravity. The fluid is pumped in a known manner as previously described. Two conventional pumping systems 152, 154 are illustrated in FIG. 9 as providing fluid through lines 153, 155 to respective sides of the frame assembly 122. With regard to the embodiment shown in FIG. 10, the pumping system 152 pumps into the conduits 142*a*, 144*a*, and the pumping system 154 pumps into the conduits 142*b*, 144*b*.

Once the frame assembly 122 has dropped to a desired angle from horizontal, it is moved transversely so that the side members 124, 126 are pulled along outwardly of the respective sides of the site 100 and so that the cross member 128 is pulled along beneath the bottom of the site 100. This transporting of the frame 122 is done by vehicles 156, 158, specifically cranes in the illustrated embodiment, pivotally connected to the side support members 124, 126, respectively, in the same manner as described hereinabove with reference to FIGS. 1–7. That is, there are two above ground ends of the frame assembly 122, and one of these ends is appropriately connected to the crane 156 and the other above ground end of the frame assembly 122 is connected to the crane 158. Depth and path can be controlled by adjusting the angle of attack of the cross member 128. Throughout this process, fluid is pumped into the conduit system of the frame assembly 122 for cutting the soil and for emplacing the barrier material which is initially fluidized but which ultimately hardens to become the desired barrier structure.

Once the material for the bottom wall or portion of the basin 104 has been emplaced, the frame assembly 122 is extracted from the soil. This can be accomplished by drawing the assembly outwardly along the plane where the wall of region 120 is to be constructed. During extraction, fluid is still pumped to cut the soil and emplace the barrier material along this planar volume. Extraction is facilitated by disassembling the pieces of which the support members 124, 126 and the conduits are contemplated to be comprised as described above with reference to FIGS. 1–7.

Figure 11:
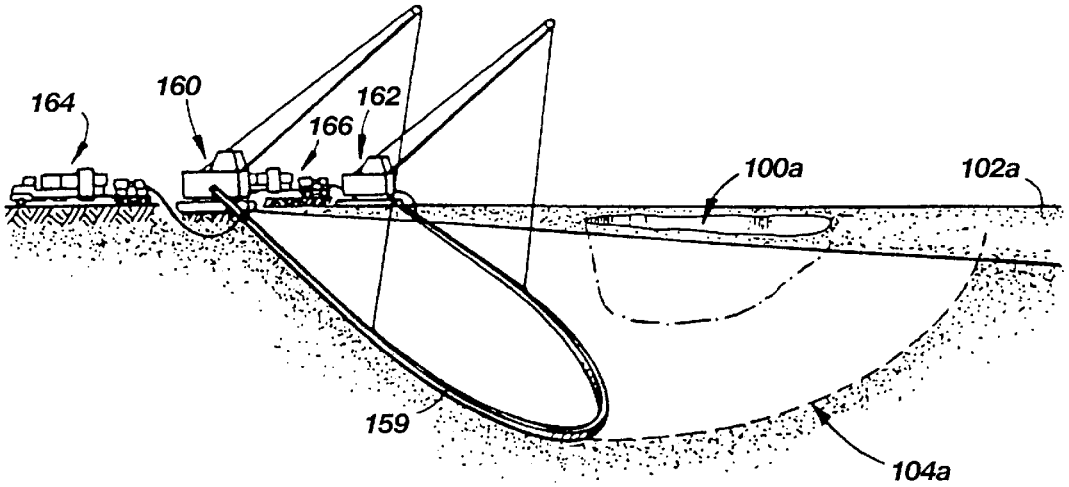
FIG. 11 is an illustration of another particular implementation of the present invention.

Referring to FIG. 11, another embodiment of the present invention will be described. In this embodiment, a single flexible cutting member 159 is flexed into an elliptical arc by its own weight as it cuts a bowl shaped path under the waste site 100*a*. The cutting member 159 is similar to the vertical side supports and conduits of the embodiment shown in FIGS. 9 and 10. That is, it has one or more moving jet orifices which are to be reciprocated along various lengths of the support members, but it is long enough to be flexible. Movement of the orifices is made via steel (or other suitable material) cables which are operated from tractor units 160, 162, such as conventional cranes, on the surface in the same manner as in the embodiment of FIGS. 9 and 10. By way of example, the cutting member 159 can include a conduit framed in a steel box of rectangular cross section, which box is long enough to behave elastically. The void space in the box is filled with a dense fluid to prevent buoyancy. An opening in the box permits fluid ejected from the conduit to cut and mix with the adjacent soil.

The flexible member 159 is initially laid in an elliptical trench or path on the surface. As the jetting action begins when fluidized barrier material is pumped from the pump trucks 164, 166, the soil is cut and mixed with the fluid and the loop made by the member 159 begins to drop through the cut soil, pivoting relative to the tractor units 160, 162 to which the two ends of the loop are connected. This is continued until the loop reaches a desired angle (e.g., 45 degrees). The tractor units 160, 162 then begin advancing at a selected rate to allow the loop to maintain a preferably 30 to 60 degree angle to vertical. Raising the tool back to the surface after completing its path under the waste site 100 can be accomplished by intersecting an existing slurry trench, displacing the dense fluid in the tool with air, or by shortening the cutting member in stages.

Figure 12:
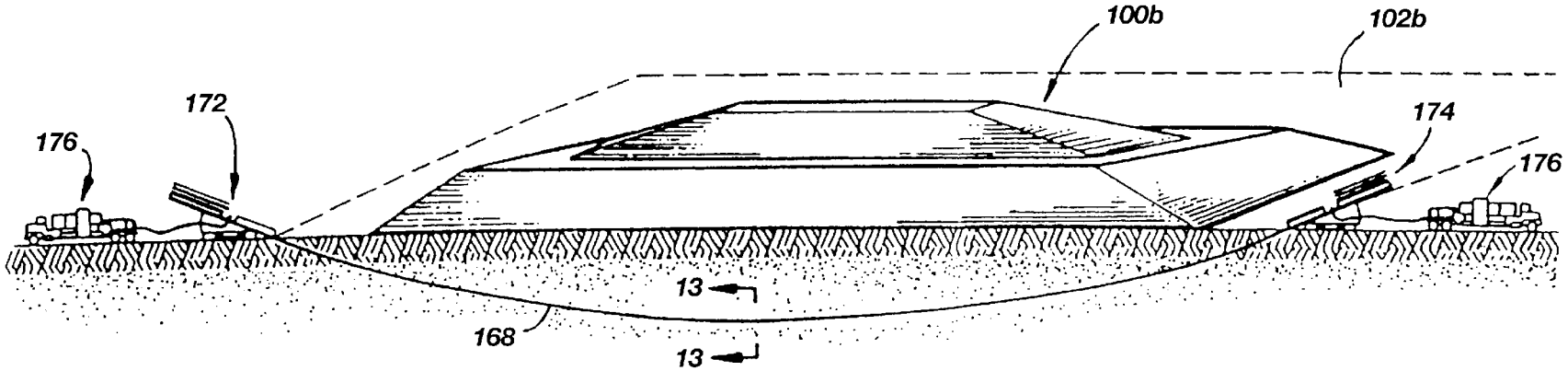
FIG. 12 is an illustration of a further particular implementation of the present invention.
Figure 13:
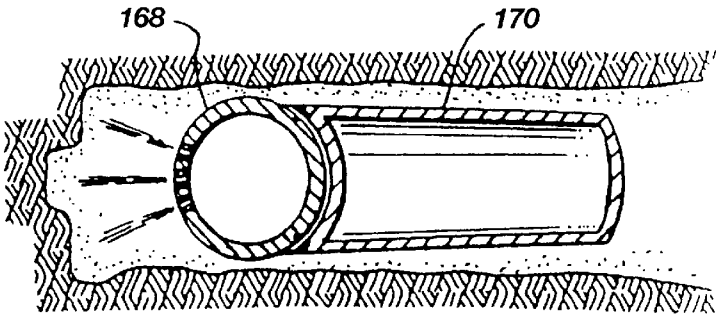
FIG. 13 is a sectional view, as taken along line 13—13 in FIG. 12, of a conduit and stabilizer of the implementation shown in FIG. 12.

Referring next to FIGS. 12 and 13, the embodiment illustrated in these drawings is similar to the embodiment of FIG. 11 except that the entire arcuate cutting member 168 of the embodiment of FIGS. 12 and 13 is reciprocated instead of just the orifices thereof. The cutting member 168 includes a flexible steel (or other suitable material) conduit, such as a string of coupled pipe sections, of sufficient wall thickness (e.g., 2–4 inches) and cross-sectional width (e.g., by incorporating a stabilizer tail 170 shown in FIG. 13) to provide directional control. The jetting orifices are suitably spaced (e.g., 25' to 100') along the length of the member 168.

The entire member 168 is reciprocated through the resultant trench by the tractor units 172, 174 located on each side of the waste site 100*b* beneath which the basin is to be formed. Each tractor unit in this embodiment preferably includes a side boom pipeline tractor equipped with a powered member handling unit capable of pushing or pulling the member 168 in 100' strokes in concert with the opposite unit. As reciprocation occurs, fluidized barrier material is pumped under high pressure (e.g., 2000 psi to 5000 psi) into either or both ends of the member 168 from conventional pump trucks 176, 178 suitably connected to one or both ends of the conduit as in the other embodiments.

If the member 168 wears sufficiently that it needs replacing, the entire member 168 can be pulled out one end of the trench while a new member is pulled in from the other end. To try to reduce wear, the fluidized barrier material ejected from the orifices of the member 168 can include one or more substances which lubricate the outer surface of the member 160.

Although the size of any of the foregoing embodiments is not necessarily theoretically limited, it is contemplated that the embodiment of FIGS. 12 and 13 may be most suitable for long working distances (e.g., 400' to 800', whereas the embodiments of FIGS. 9–11 may be practical only up to 200' to 500', for example). Such long distances may be encountered in containing very large sites such as mining waste piles. The last described embodiment (FIGS. 12 and 13) also has relatively low cost subsurface components (in its simplest form, it can be only a pipe string having jetting orifices), thereby requiring possibly less capital investment.

Figures 14, 15, 16, 17:
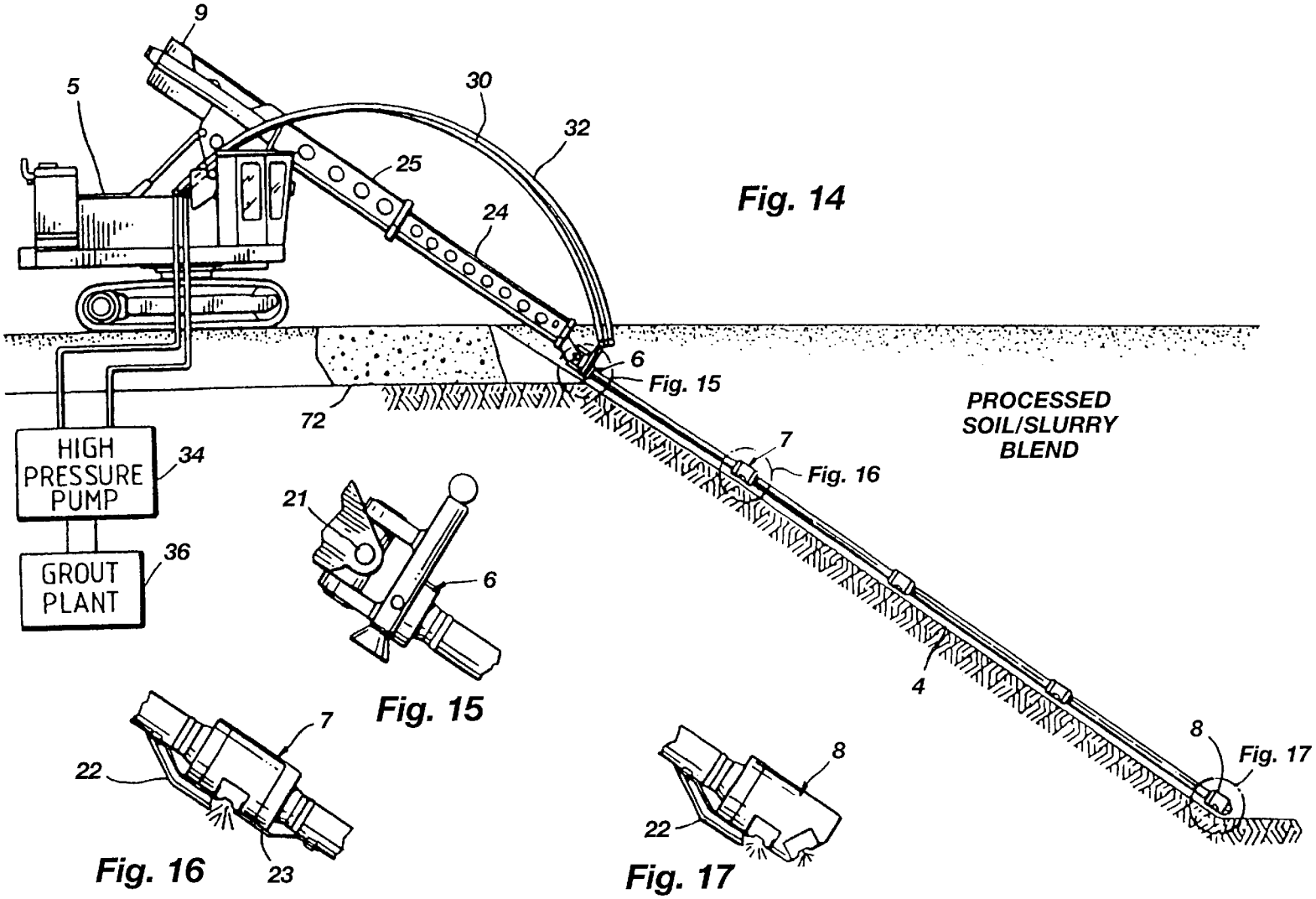
FIG. 14 is an illustration of a preferred embodiment for cutting soil and forming subsurface containment barriers.
FIG. 15 is an illustration of the pivot point between the beam and boom of FIG. 14.
FIG. 16 is an illustration of the jet port area of FIG. 14.
FIG. 17 is an illustration of the end jet port area of FIG. 14.

The apparatus shown in FIG. 14 is a preferred embodiment for cutting soil and forming subsurface containment barriers. The support 5 is a telescoping boom excavator, such as the Gradall 880 excavator. A pilot trench 72 is cut in known manner. A source of fluid is provided by lines 30 and 32 to the top of the beam 4 which is also the conduit for the means for creating a cutting action. The fluid lines 30 and 32 are preferably connected to high pressure pump 34 and grout plant 36 in order to provide a high pressure grout slurry. The beam 4 is preferably a heavy wall steel pipe which comes in 12 foot sections with linking assembly 6 shown in more detail in FIG. 15 which shows pivot point 21 which allows beam 4 to pivot relative to boom 9, with jet port area 7 shown in more detail in FIG. 16 which contains a plurality of jet ports across its width and a cutter 22 which breaks up small obstructions contacted in its reciprocating movement, and failing that will stop the conduit and direct the force of the jet streams against the obstruction until it is destroyed. Shield 23 helps eliminate sharp edges and possible snags on obstructions at this point on the beam 4. End jet port area 8 is shown in more detail in FIG. 17 and contains jet ports to cut at different angles from the axis of beam 4 in order to cut away obstacles that might interfere with the end of beam 4 and also containing cutter 22 which serves the same function as the cutter shown in FIG. 16. Beam 4 is attached to boom 9, which comprises means for providing reciprocating action, preferably by a hydraulic cylinder with an inner cylinder structure 24 which moves in and out of outer cylinder structure 25. Cylinder structure 24 preferably comprises a cylinder and a rigidifying support structure.

Boom 9, attached to support 5, has the capability of rotating back and forth around the axis of the length of the boom which provides the capability to change the direction of the cutting action from the reciprocating jet streams in order to turn corners to shape the containment barrier being formed, to avoid obstacles, etc.

With regard to all the embodiments, mechanical cutters as shown for the embodiments of FIGS. 1–7, for example, can be affixed to the subsurface members of the present invention to aid in cutting a path through the soil, which cutting is primarily performed hydraulically in the illustrated embodiments.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

The soil cutting according to this invention is preferably accomplished by rapidly moving the fluid jet streams from the cutting means of the apparatus of this invention across the face of the soil being cut so as to force all the cutting action to occur within 100 jet diameters of the jet orifice or port, and more preferably within 70 jet diameters. Cutting efficiency drops off exponentially with increasing distance between the soil to be cut and the jet orifice or port. For example a 0.078 inch diameter jet nozzle operating with 5000 psi fluid should cut 4 times as many cubic inches per second at 4 inches as it does at 8 inches away from the target soil. To keep the fluid jet streams from penetrating too far into the soil with common soils it is preferable to move them at linear velocities from 1 to 6 feet per second, with 2 to 4 feet per second being more preferred. The preferred cutting distance also depends on the size of the jet orifices used.

Soil cutting is continued while the conduit is pulled transversely to its length so that the trench is extended transversely to its length. Referring to FIG. 8, by way of example, the frame by which the locus 106 is defined sinks through sectors 108, 110 and partial cylinder 112; the frame is then pulled through the remainder of the volumes 114, 116, 118, 120. This is controlled so that the transversely extended trench extends not only alongside but also underneath the volume of soil or material within the confines of the resultant basin. Pulling of the conduit occurs either or both automatically in response to gravity due to the density of the conduit or its support or mechanically in response to movement of a suitable vehicle such as a crane or other suitable tractor unit.

The diameter of the fluid ports of this invention may vary over a wide range. However, with preferred fluids port diameters between 0.078 inch and 0.156 inch are preferred. Using standard 900 horsepower pumping units, jet ports of a smaller diameter are operable. However, smaller diameter jet ports are also more prone to plugging and must be moved at a faster speed. Since there are a finite number of jet streams that can be produced, the jet ports must be spaced more widely as the depth or cutting face area increases.

The length of the stroke of the reciprocating mechanism which moves the jet streams across the soil to be cut may be from about 4 feet to about 40 feet long with 8 feet to 16 feet being the preferred stroke length to be compatible with existing telescoping boom excavating equipment. Shorter strokes require greater numbers of jet streams and smaller diameter jet ports.

The high pressure fluid used to cut and modify the soil is preferably pumped at pressures from about 400 psi to about 10,000 psi, with 2000 psi to 5000 psi being more preferred in common soil types.

The weight of the cutting means in a slurried soil is preferably sufficient that at any given operating angle the reaction thrust of the jet streams is less than the forward thrust due to gravity.

The soil cutting method and apparatus of this invention can be practiced with any type of support or carrier such as a crane, tracked backhoe, cherry picker, tractor, truck, or a dozer. A preferred support is a telescoping boom excavator such as the Gradall 880 excavator for moderate depths of about 70 feet. This unit is preferred because it has a powerful reciprocating mechanism. This eliminates the need to add this capacity to the support. The Gradall excavator's ability to rotate the conduit of the cutting means is also desirable for turning corners in the soil with the apparatus of this invention. A special hydraulic valve package may be added to this unit to automate both the reciprocation and the travel of the carrier.

The preferred apparatus consists of a network of electric solenoid valves which, when activated, for example by a push button, cause the beam 4 of FIG. 14 to automatically reciprocate at top speed. Moving any of the standard joystick controls will shut off the automatic mode and restore normal operation. When in the auto stroke mode the movement of the excavator is controlled by a sensor mounted on the end of the boom. When the beam 4 of FIG. 14 falls to a specified angle with respect to the boom 9 the tracks are automatically activated to move the excavator several inches backward (but in the direction that the soil cutting is proceeding). This tends to keep the beam 4 and the boom 9 parallel or at a preset angle with respect to each other. A gravity reference angle sensor mounted on the non-reciprocating portion of the boom 9 allows the operator to set the angle of the boom in order to exercise a degree of control over the depth of operation.

The preferred soil cutting apparatus of this invention can be operated with any type of pumpable fluid. A fluid which will set up into an impermeable barrier is preferred. Especially preferred are those which will form long lasting barriers, such as Portland cement based fluids. Such a fluid preferably contains particles no larger than about ⅓ the diameter of the jet port. The preferred fluid for forming impermeable walls is a mixture of Portland cement, bentonite, or flyash with water. The final wall material is preferably formed from 1 part jetted slurry and from ½ to 2 parts original soil The slurry composition is preferably designed to give acceptable final properties within a wide range of soil loadings. Other materials such as hot wax or polymer grout can also be used. Polymer gelled water may be used when it is desired to form a temporary slurry filled trench wherein a drainage pipe is laid and the trench filled with permeable material for the purpose of intercepting and recovering contaminated groundwater. Additionally, it is also to be noted that the density and gel strength development characteristics of the fluidized barrier material mixed with the cut soil should be adequate to support the overburden weight.

The cutting means of the apparatus of this invention preferably comprises one or more conduits for high pressure fluid, preferably weighing from about 50 to about 150 pounds per linear foot with 80 to 120 pounds per foot being most preferred for common soils where a 12 inch wide wall is to be formed. The cutting means may be relatively flexible or relatively rigid, with greater rigidity being preferred to make monitoring of operating depth more accurate. The spatial orientation of the jet streams may take many forms but the preferred form is to have a transverse row of 5 to 7 jet streams covering a width of 12 inches. These jet streams are preferably perpendicular to the axis of the conduit of the cutting means.

In a preferred embodiment this row of jet streams is repeated every 12 feet of the length of the conduit. An additional group of jet streams is preferably added on the bottom end of the conduit of the cutting means which is angled 45 degrees forward to aid in cutting into hard formations. The diameter of the jet ports chosen for any particular row may be varied according to the hardness of the soil at that level. The conduit may be fabricated in one or more pieces but the preferred method is to fabricate the conduit in modular 12 foot long sections with the rows of jet streams mounted in replaceable holders every 12 feet of conduit length.

At each row of jet streams it is preferred to have a knife edged protrusion (cutter) which is intended to catch on any solid obstructions which are encountered on the downward stroke of the up and down movement of the reciprocal movement of the cutting means. The cutter serves to break up small obstructions or failing that it will stop the conduit and direct the force of the jet streams against the obstruction until it is destroyed.

The diameter of the conduit of the cutting means preferably varies in size, being significantly smaller generally compared to the diameter of the area where the jet ports are located, in order that rocks and debris which are loosened by the jet streams may readily pass around the relatively small diameter conduit. This may be accomplished by adding a truss to the arm of the cutting means with large openings to allow for the passage of rocks and debris. Preferably for a saw which cuts a 12 inch wide path and has a modular jet port area which is 12 inches wide connected to a body of heavy wall steel pipe. A preferred steel pipe contains a 6.5 inch outside diameter and a 3 inch inside diameter.

The flow rates of the fluid through the conduit of the apparatus of this invention preferably vary from about 50 gallons per minute to about 1000 gallons per minute, and more preferably from about 200 to about 600 gallons per minute.

The cutting means of this invention may also include a vibrating in place of the conduit for transmitting fluids to form reciprocating fluid jet streams. The vibrating beam cuts the soil by the combination of resonant vibrations, the shape and size of the beam and the weight of the beam per unit length of the beam. A hardening fluid is pumped down a smaller conduit attached to the beam. This fluid is mixed into the soil by the vibration of the beam.

In addition to obtaining downward force by means of gravity downward force may also be applied mechanically or hydraulically, or by pulling a trailing cutting means angled downward into the soil forward through the soil by means of a tractor or other carrier means. By locking the angle of the cutting means to ground in place as the cutting means is pulled forward additional downward force is applied to the cutting means.

For very deep cuts into the soil, such as over 25 feet in depth, the use of gravity to increase the downward force into the soil is increasingly important since it becomes difficult if not impossible through normal soils due to strength of materials and the limited power of carriers to pull such cutting means through the soil at all, or to do so without bending or otherwise distorting the cutting means out of shape.

Common soils for best results of the applications and methods of this invention are sandy soil, loam, moist clay, gravel, baked clays, hardened Texas gumbo and combinations thereof. Solid rock generally is not acceptable. However, the preferred fluid cutting of this invention can cut through steel pipe and very strong debris materials when the various cutting parameters are optimized for cutting through such materials according to the normal skills of this art.

As noted above, the cutting means of the present invention may be relatively flexible or relatively rigid. While greater rigidity may be preferred in some cases to simplify monitoring of operating depth, in other cases greater flexibility will be more important. Typically, the latter will be true where odd-shaped containment barriers are to be formed.

Figure 19:
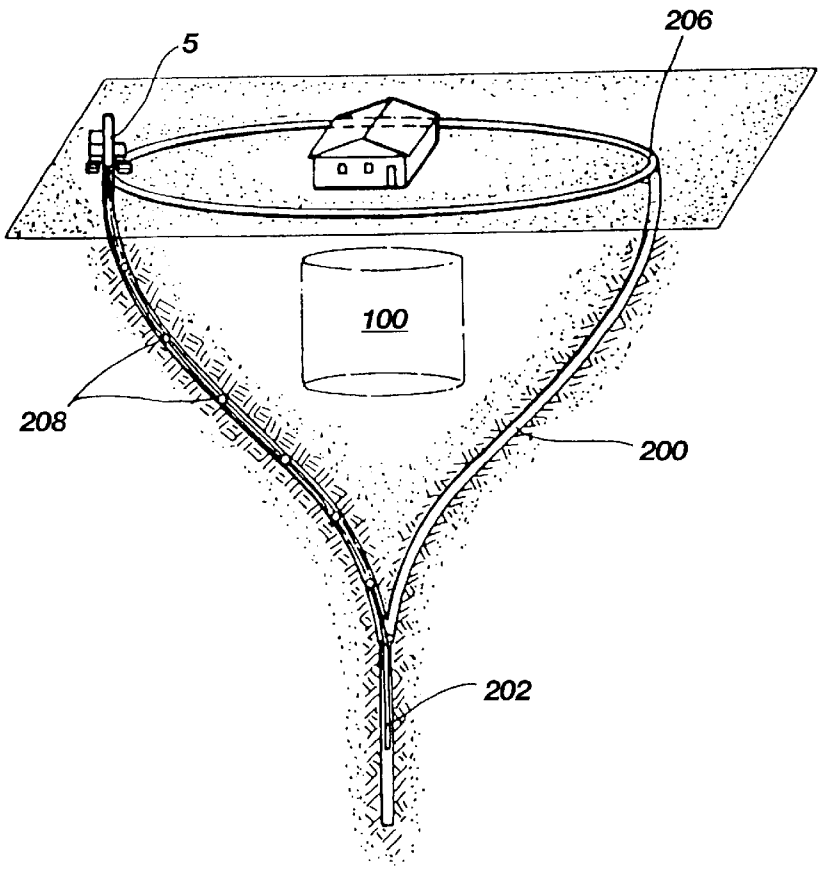
FIG. 19 is a side view of the illustration of FIG. 18.
Figure 18:
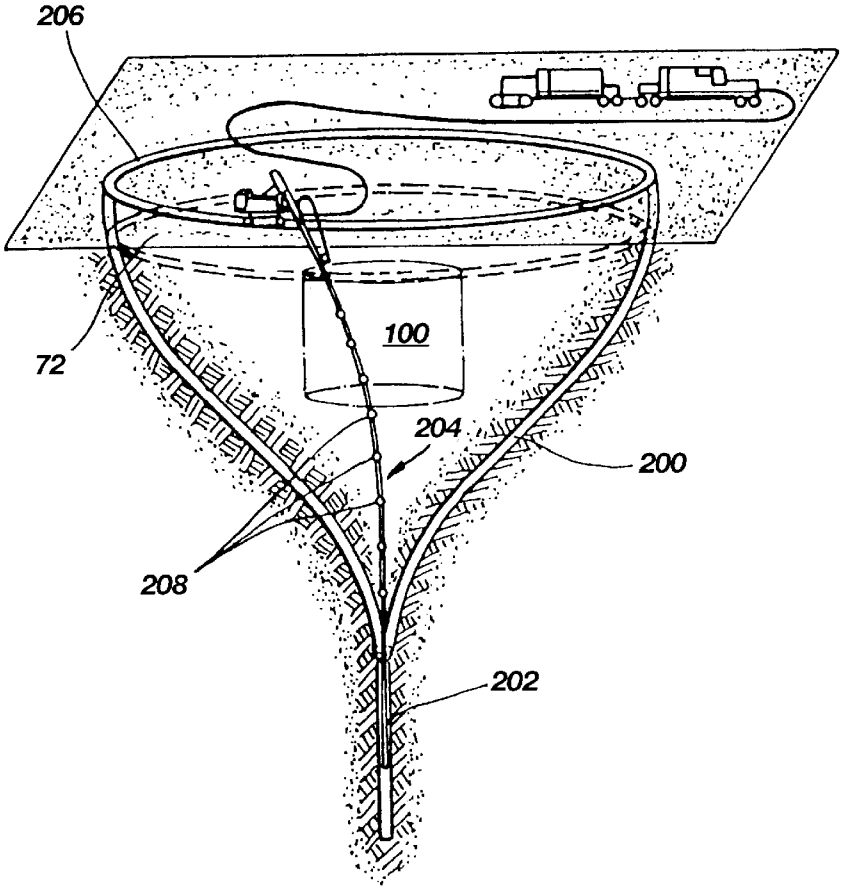
FIG. 18 is an illustration of a particular implementation of the present invention suitable for constructing a cone-shaped containment barrier.

For example, as shown in FIGS. 18 and 19, the present invention is useful for forming a containment cone around and under a waste site. Typically, such a barrier structure is needed for sites that are generally circular in shape and that have very limited access. The tankfarm of buried circular tanks used to store radioactive liquids at Hanford, Wash. is such a site.

To form containment cone 200, an anchor 202 is placed deep under the center of a waste site 100. This placement may be accomplished using directional drilling, jet grouting and oil well cementing techniques, or any other suitable techniques. The exact depth at which the anchor is placed naturally depends on the depth of the waste to be contained and on the ability of the excavator 5 to generate the desired reciprocating action. By way of example only, an anchor 202 may be placed about 200 feet below the surface of a site 200 feet in diameter.

The anchor 202 acts to secure the end of jet grouting lance or cutting bar 204 and/or to guide the cutting bar's reciprocating action. In one embodiment, for example, a cable or chain guides jetting pipe 204 to a point under the center of the waste site 100 and roughly corresponding to the location of a "dead man". The end of the jetting bar 204 may be secured to the "dead man" by a cable or chain. In the preferred embodiment, however, the anchor 202 is a vertical steel sleeve placed deep into the soil. After the sleeve has been cemented in place, the jet grouting pipe's lower end is run into the sleeve such that the pipe 204 can reciprocate through its stroke without its lower end coming out of the sleeve.

The pipe handling unit 5 on the surface reciprocates the jetting pipe 204 as fluid is jetted from jet port areas 208 to liquify the soil in its path. Typically, the jetting pipe 204 will be reciprocated through a distance approximately equal to or greater than the distance between adjacent jet port areas. As the pipe handling unit 5 moves on the surface around circle 206, the cone 200 of barrier material is formed which, upon hardening, becomes a permanent waste containment barrier. A pilot trench 72 may be used to facilitate the travel of the pipe handling unit 5 and the formation of the containment barrier. The containment cone 200 may appear to be either a regularly-shaped cone with straight sides and having its pointed end down, or an irregularly-shaped cone with curved sides more closely resembling the top half of an hour glass. The pipe handling unit 5 may be an excavator as described herein, a drilling rig on tracks, or any other suitable mechanism capable of generating the desired reciprocating action.

Figure 20:
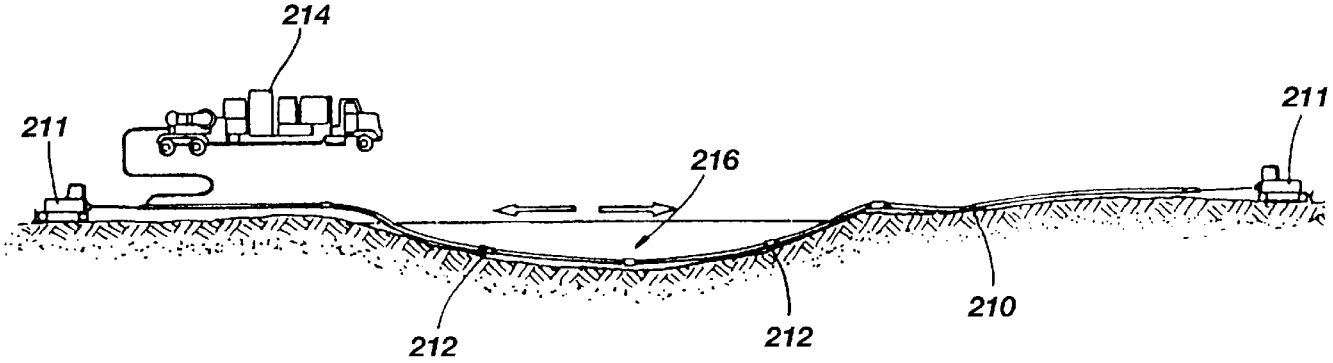
FIG. 20 is an illustration of a particular implementation of the present invention suitable for constructing deep barrier walls.

As mentioned in the above discussion of the embodiments of this invention shown in FIGS. 11–13, the cutting apparatus of the present invention also may comprise a catenary cutting bar. The catenary cutting bar or beam typically has jetting ports or subs spaced along its length. The catenary beam is elastically bent into the general shape of the letter "U" to form the cutting device. In accordance with the present invention, the catenary cutting bar can be used to form a number of different types of containment structures. For example, use of the catenary cutting beam to form deep barrier walls is illustrated in FIG. 20. An elongated cutting beam 210 comprising heavy pipe is laid upon the ground or within a pilot trench alongside a waste site or any other location where a barrier wall is to be formed. A bulldozer, backhoe, or other means 211 for reciprocating the pipe 210 is attached to at least one end of the pipe 210. Preferably, one dozer 211 is attached to each end of the cutting pipe.

The pipe 210 has jetting subs or ports 212 spaced along its length. In the preferred embodiment, the ports 212 are spaced apart a distance of from about 30 to about 50 feet. The pipe 210 preferably weighs between 30 and 110 pounds per foot. The reciprocating apparatus 211 (dozers) reciprocates the pipe 210 while also maintaining a tension on the pipe 210 to limit the pipe's depth. Thus, pipe 210 of the catenary beam is made extra heavy to generate a downward force to balance the upward vector due to the tension from the dozers 211 and the reaction thrust of the jets. For instance, a steel pipe three inches in diameter by 1½ inch thick by 400 feet long may be used, although the invention is not specifically limited to use of such a pipe. Preferably, the pipe used will be locally rigid, i.e. rigid enough to resist bending due to the jetting thrust but overall flexible enough to form a generally U-shaped cutting device.

A slurry pump 214 capable of delivering a cutting fluid from a supply is connected to at least one end of the pipe 210. The pipe 210 preferably acts as a conduit for the slurry or cutting fluid between the pump 214 and the jetting subs 212. As slurry pumped through pipe 210 exits through the jetting subs 212, the soil below or facing the subs 212 is liquified. Thus, as the dozers 211 are moved in tandem to the right and then back to the left, the pipe 210 is reciprocated. By moving the dozers to the right through a distance slightly greater than the distance between the jetting subs 212, and then back to the left the same distance, the soil along the entire length of the cutting beam 210 is liquified by the exiting slurry.

Figure 21:
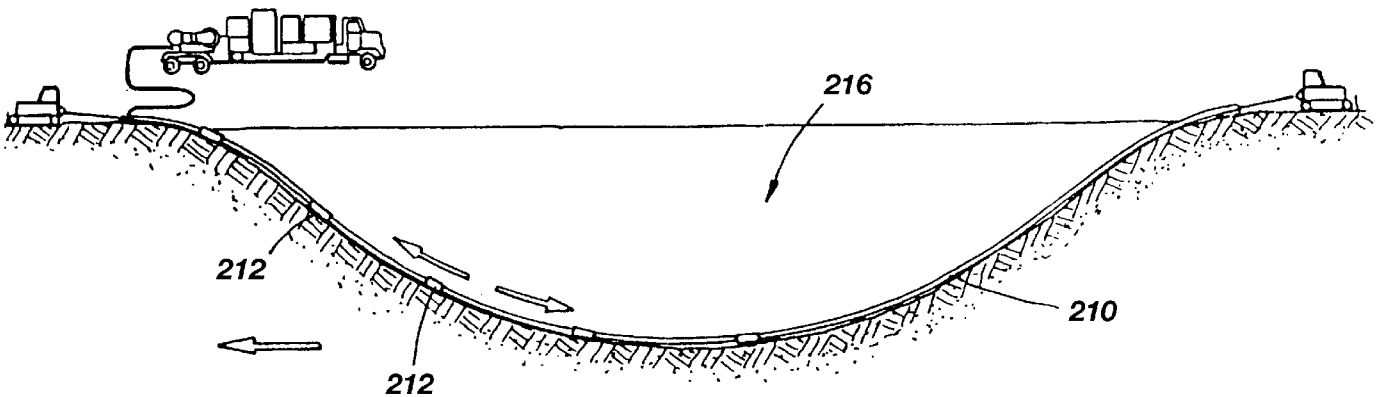
FIG. 21 is an illustration of the implementation shown in FIG. 20.

As the soil is liquified, the catenary cutter 210 sinks into the soil/slurry mixture 216 to form barrier wall 218. Additional sections of pipe with additional jetting subs may be added on either end of the cutting pipe 210 as needed to permit the formation of deep barriers. As shown in FIGS. 20 and 21, as the cutting pipe 210 sinks, the barrier wall becomes U-shaped, and the length of the cutting pipe 210 within the barrier being formed increases. To extend the barrier wall to the right or left, additional pipe is added, and the dozers 211 reciprocating the cutting pipe are moved such that the stroke in one direction is longer than the stroke in the other. Worn or plugged sections of the pipe may be "circulated" to one end while new replacement sections of the pipe are fed into the ground from the other end. This circulation allows the cutting system to recover from plugged jet nozzles or other mechanical damage due to wear or other causes in the middle of a project without having to start over again. Further, blanked-off sections of pipe not containing any jet nozzles may be added to the length of the pipe so that the blanked-off sections make up 30 to 50 percent of the length of the pipe between the dozers. Thus, as the active portion of the cutting pipe liquefies the soil below it and descends to an arc, the blanked-off sections are drawn into the trench also.

A barrier wall can be extended by detaching one of the dozers 211 and lengthening the stroke in one direction. In such case, to maintain the jetting subs in close proximity to the soil to be cut, the cutting pipe preferably is reciprocated while travelling at linear speeds of 2 feet per second or greater. The leading end of the substantially flexible pipe functions much like a falling beam cutting device in that although the flexibility of the pipe eliminates the need for a pivot point at a ground level, the weight of the cutting pipe presses the jetting nozzles against the soil to be cut. Also, like the falling beam cutting device, the jet nozzles preferably are in close proximity to the soil to be cut. This cutting distance is preferably within 100 jet nozzle diameters of the jet nozzle orifice. For the preferred jet nozzle size of 0.078 inches, this distance is 7.8 inches, with 4 or 5 inches being the most preferred distance. As mentioned above, cutting distance depends on the linear travel rate of the cutting pipe and also varies with the size of the jet diameter used.

Figure 22:
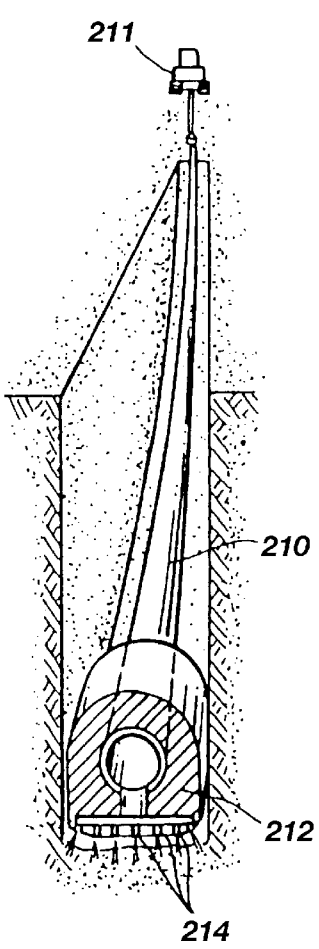
FIG. 22 is a sectional view of the implementation shown in FIGS. 20 and 21.

A jetting sub is a section of the cutting pipe having a plurality of orifices oriented such that all of the orifices are directed substantially in the direction of the cut to be made such that the jets are able to liquify a cut through the soil approximately equal to the cross section of the jetting sub. Cutting action preferably occurs within 100 jet nozzle orifice diameters of the jet nozzle orifice of the jetting sub. As shown in FIG. 22, the jetting subs 212 having a plurality of exit ports 214 will cut a path that typically is wider than the outer dimension of the cutting pipe 210. Preferably, the path cut is twice as wide as the cutting pipe. Hardened steel cutting teeth may be added adjacent to each jetting sub to assist in cutting through rock or debris which is encountered.

The depth of the barrier being formed may be monitored by attaching a small (e.g. ¼ inch) steel cable or measuring line to the pipe at the bottom of the arc and using the cable to measure the vertical depth of the pipe periodically. Measuring instruments also may be lowered down on the cable, or a float may be connected to the cable, to give some indication of depth. Instruments such as are used in the directional drilling industry also may be used to sense the position of the pipe. The direction of travel of the dozers may be monitored by means of a telescopic or non-telescopic rifle site rigidly mounted on each dozer which is aimed at a marker or pole in line with the wall to be formed and distant from the dozer. A second marker or pole may be located behind the first at a greater distance to supplement the guidance using the rifle site. This siting system allows the dozer operator to receive accurate feedback of any course deviation and make rapid course corrections before the pipe becomes wedged in the trench or barrier being formed.

Figure 23:
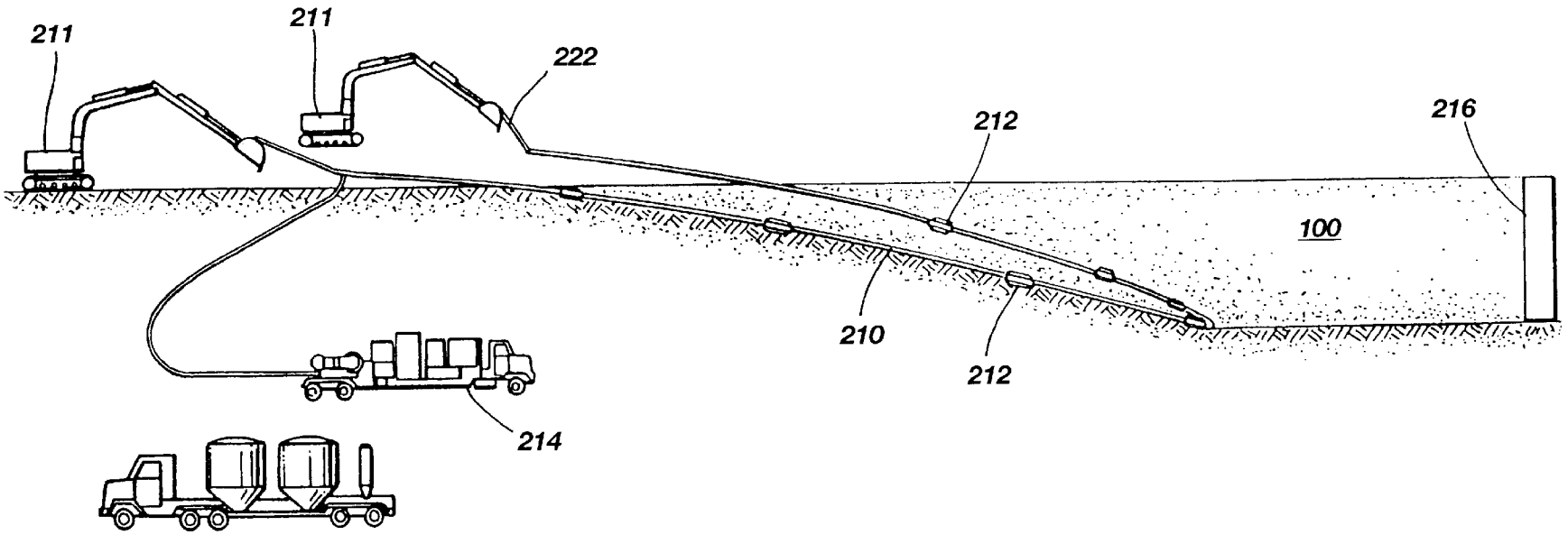
FIG. 23 is an illustration of a particular implementation of the present invention suitable for constructing a containment barrier using the catenary cutting apparatus of the present invention.
Figure 24:
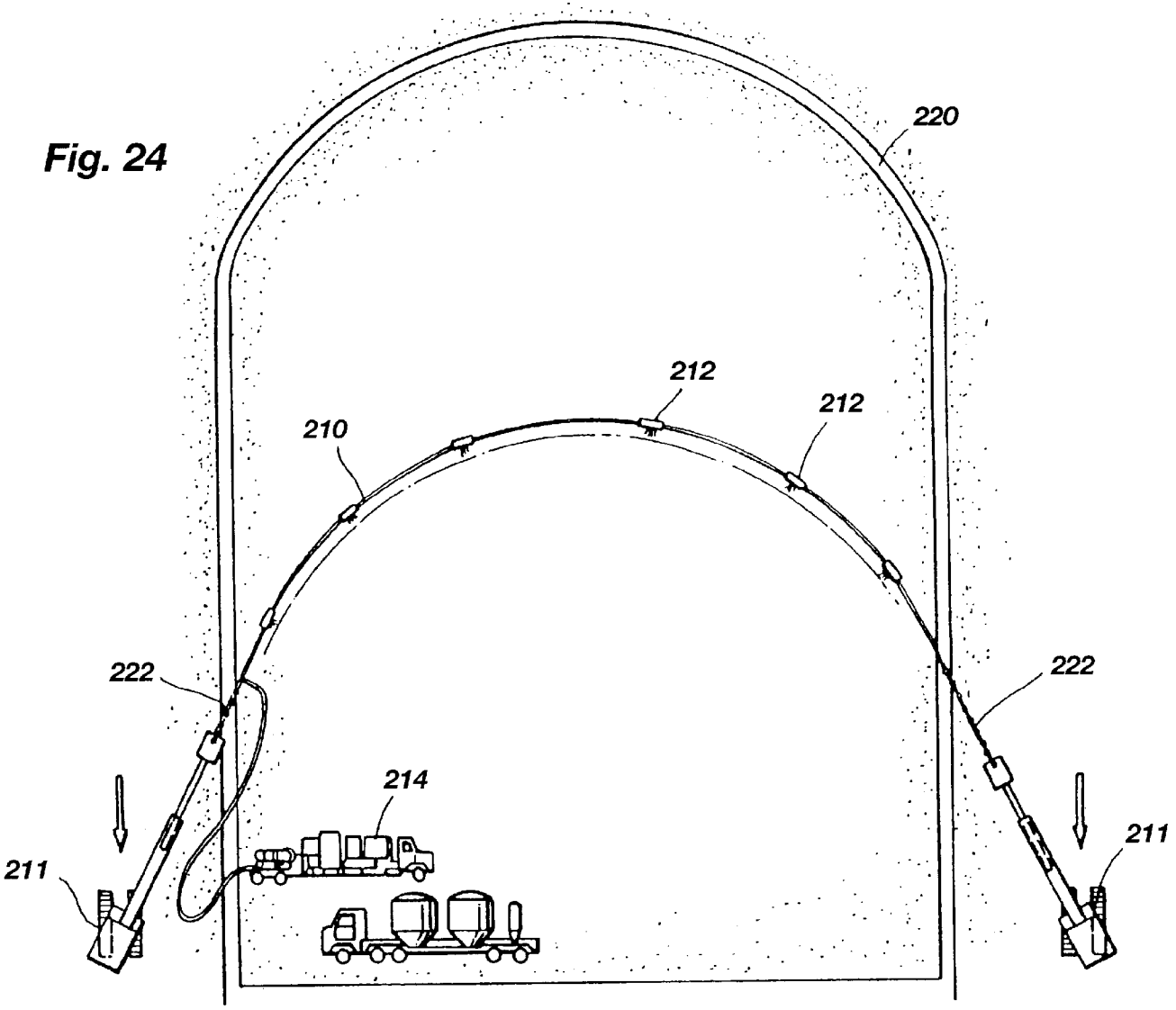
FIG. 24 is a view from above of an alternate embodiment of the implementation shown in FIG. 23.

Once a wall or barrier has been formed according to the method of the present invention, a complete containment structure can be formed around and under a waste site by appropriately rotating or otherwise directing the cutting beam. A method of directing the catenary cutting beam was mentioned earlier in conjunction with the discussion of FIGS. 11–13. As shown in FIG. 23, after a deep barrier wall 218 has been formed, cutting bar 210 is rotated 90 degrees and the reciprocating means 211 are turned so that as the cutting bar 210 is reciprocated a path is cut beneath the waste site 100. Also, as shown in FIG. 24, the initial starting trench need not be a straight barrier wall. A curved starting ditch 220 (formed, for example, by the apparatus shown in FIGS. 14–17) may be used with the catenary cutter 210 of the present invention. In such a case, the use of a flexible linkage, cable, or chain 222 between the reciprocating means 211 and catenary cutter 210 may be helpful as providing increased control over the direction of cutting.

A second type of flexible linkage preferably is attached to the catenary beam conduit at a point approximately where the curve of the catenary conduit strengthens out. The flexible linkage is of sufficient length so that the trailing conduit may be pulled along behind the catenary conduit when making a forward stroke but may retain its position when that side of the catenary conduit is moving rearward.

Additional directionally drilling placed pipes above and below the preferred elevation of the centerline path of the catenary beam may be electrically instrumented so that the operator can determine when the catenary beam makes contact with one of them. Also portions of the pipe forming the catenary beam may be instrumented with a directional drilling type sensor, such as three-axis magnetometers and three-axis accelerometers, which give the operator an accurate way to monitor the depth and location of the pipe. Such instruments may be run inside the pipe and moved from place to place or may be locked in position and function while the jetting device is operating.

While the present invention describes equipment and methods for creating "bathtub shaped" hydraulic containment structures in situ under existing contaminated land areas (see, e.g., FIG. 8), the method can also be used to form temporary or permanent containment barriers or bowls under waste sites, such as those having buried explosives or chemical weapons, to prevent migration of containments and facilitate wet excavation procedures. Many sites exist where artillery shells of chemical or conventional type have been placed in an open pit, broken open, burned, and buried. The government now wishes to excavate and clean up the land but it is known that many undamaged shells also exist in these burial pits. This invention will make it possible to place a containment barrier under such a site. With the barrier in place wet hydro-excavation techniques may be used to remotely remove the soil while introducing bleach to neutralize the chemicals.

Thus, several methods and tools are described which may be applied either alone or in combination to address specific needs at different sites. Specific materials are also described which are applicable to these methods. In addition, the invention can be used either alone or in conjunction with other materials and methods to place a durable covering or cap structure over the top of these "bathtub" containment structures to completely encase the contamination in a vault.

One problem typically associated with prior art methods for forming containment barriers is an absence of some mechanism for reliably forming panels or other containment structures which are continuously joined to a previously emplaced panel or structure. To form large or multi-acre structures without disturbing the waste or existing cap structure such a mechanism is needed. The tracking or stitching method of the present invention overcomes the problems associated with forming multiple panels that are fully joined.

According to the present invention, a panel is formed by pulling a pair of parallel pipes through the ground with a cutting device between them to cut a path between the tracks of the two pipes. Preferably, as cutting progresses the cut soil is blending with a permeability modifying slurry. One or more additional pipes (trailing pipes) are pulled through the freshly blended soil behind the cutting device. These trailing pipes may serve as supply lines for the permeability modifying slurry or other cutting fluids being used. In addition, once a "pull" is complete, these trailing pipes may become the "pulling pipes" used to drag the next cutting device through the soil to form an adjacent panel. This tracking method helps ensure that the edge of each new panel begins within the confines of the previous panel, thus allowing for the formation of a continuous containment barrier.

Figure 25:
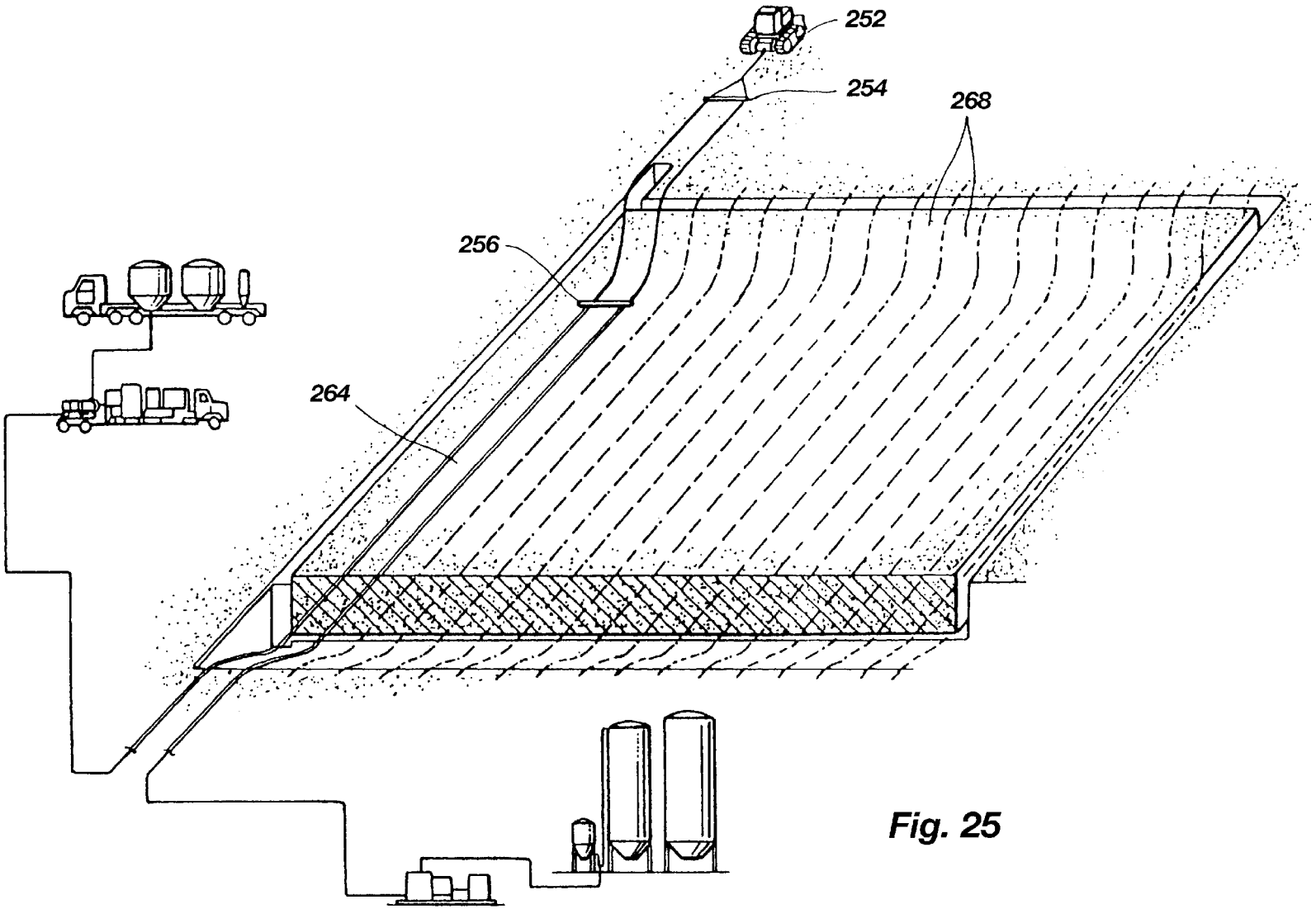
FIG. 25 is an illustration of a particular embodiment of the present invention suitable for constructing a large containment barrier using the tracking method of the present invention.
Figure 26:
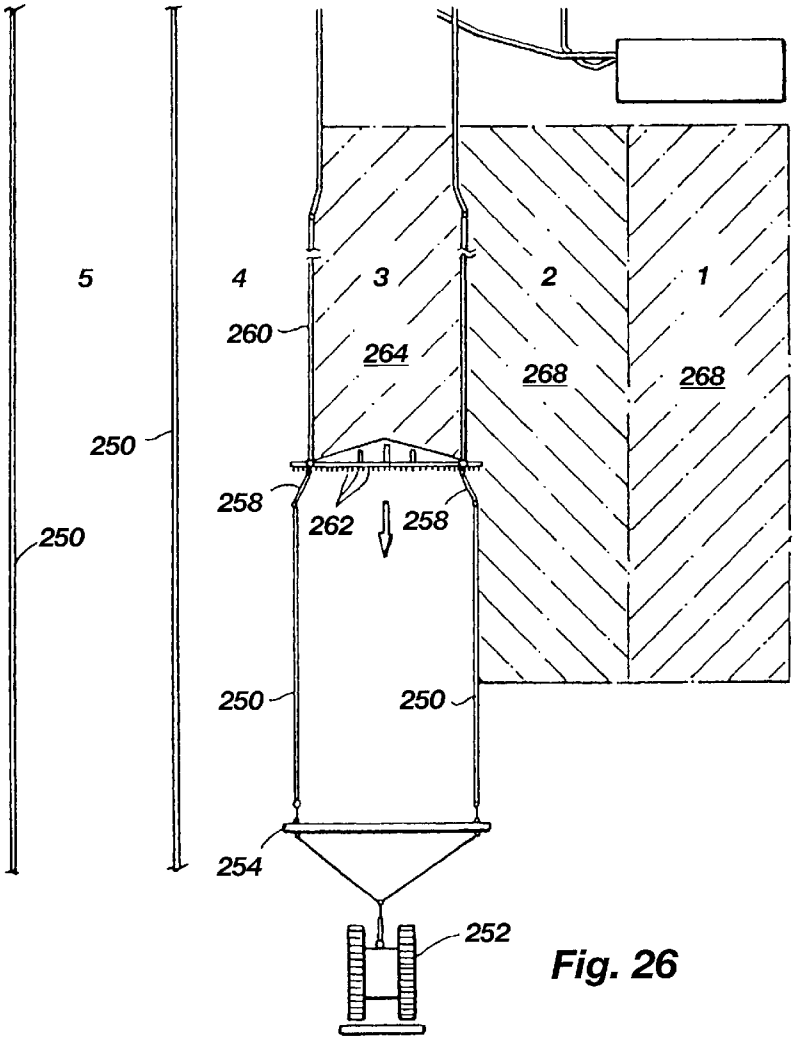
FIG. 26 is a top view of the implementation shown in FIG. 25.

As shown in FIGS. 25 and 26, substantially parallel pipes 250 are placed in arcs under a waste site. The pipes 250 generally are uniformly spaced with from about 5 to about 30 feet between adjacent pipes. Preferably, the pipes 250 are 2⅜" O.D. steel oil well tubing or other tubing which can make the desired curves elastically without permanent deformation. The pipes 250 may also enter the soil at a near horizontal angle and travel downward in an "S" bend to the desired depth, under the site to the other side, and back to the surface with another "S" bend. The exact shape of the desired curves may vary depending on the conditions present at a particular waste site or other requirements which need to be met in the particular field application of the present invention. For example, the pipes may also exit the soil vertically if a suitable pipe pulling machine is available.

A pulling means 252 is attached to one end of a pair of adjacent pipes 250. For example, the pulling means 252 may be one or more dozers, backhoes, other earth moving machines, or winches. A yoke 254 is used to allow a generally straight pull on each pipe 250.

A cutting device 256 is attached across the other end of the pair of pipes 250 by means of a flexible link or chain 258 which allows for some variance in the spacing between the pipes 250 as compared to the width of the cutting device 256. Preferably, the cutting device 256 is a jetting bar extending beyond the pipes 250 on each side to allow a path wider than the spacing between the pipes 250 to be cut. The flexible link or chain 258 also allows the cutting device 256 to tolerate any misalignment of the otherwise generally parallel pipes 250 during pulling.

Trailing behind the cutting device 256 is at least one pipe or other means which can act as a pulling pipe 250. In the preferred embodiment a trailing pipe 260 serves both as a high pressure fluid conduit for delivering slurry to the jetting bar 256 during the formation of a first panel and as a pulling pipe during the formation of a second panel attached to the first.

The cutting device 256 may be a mechanical cutting/mixing device. Preferably the cutting device 256 is a jetting bar with a plurality of jets 262 directed toward the surface to be cut. The cutting jets 262 may be fixed along the cutting bar 256 or may be rapidly moved relative to the bar 256 so that a jet's cutting action moves back and forth over the face of the soil to be cut. In the preferred embodiment the cutting jets 262 are moved rapidly so as to reduce the total number of jets 262 required. Further, the jets 262 preferably are performing work close to the orifice 266 to increase their efficiency.

The motion of the jets 262 can be induced, for example, by rotating the jetting bar 256, by reciprocating the jets 262 along the length of the bar 256, by reciprocating the entire bar 256, or by connecting the pulling pipes 250 to a catenary pipe which, together with the pulling pipes 250, is reciprocated along its length. The reciprocating action may be caused by hydraulic pressure transferred from the surface through one or more pressure conduits; by the pressure of the jetted slurry which may be modulated by a valve causing alternating pulses of pressure to come in turn from two high pressure slurry pipes; or by jet thrust through orifices in two or more separate slurry chambers of the jetting bar connected to one or more slurried lines, wherein the orifices are positioned on opposing angles. Rotation may be induced by hydraulic, electric, or air-powered motor, by a mechanical capstan powered by cables extending to the soil surface, or by a gear set driven by a rotation of one of the pulling pipes. In one embodiment the jetting bar 256 is rotated by means of a hydraulic motor, with the jets 262 placed at a 30 degree angle to the centerline of the bar 256. Preferably, though, the jets 262 are reciprocated along the length of the jetting bar 256 at a rate between about one and about six feet per second, with a rate between about two and about four feet per second being most preferred. A transverse row of jets reciprocating along the length of the bar is most preferred, although a shorter reciprocation stroke may be mechanically simpler to achieve and also may be useful. The rate of reciprocation will depend in part on the size of jet diameter being used.

Figure 27:
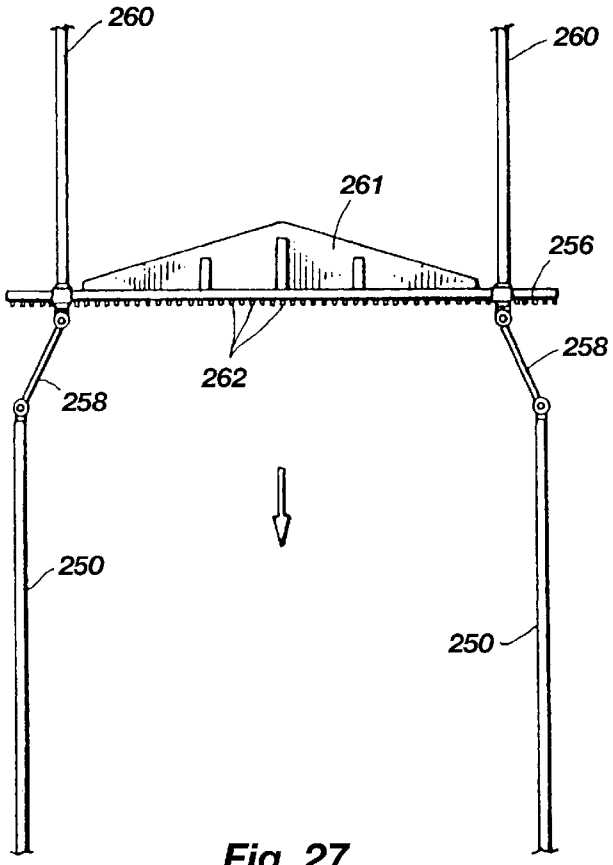
FIG. 27 is an enlarged view of the cutting device of the implementation shown in FIGS. 25 and 26.

FIG. 27 is an enlarged view of the rigid jetting bar 256 depicted in FIGS. 25 and 26. As shown, the jetting bar also may be equipped with a stiffening plate 261. This plate 261 serves to increase the operating strength of the bar 256 and also may provide some benefit in terms of controlling the direction of the jetting bar 256 as it is drawn under a site by pulling pipes 250.

Figure 28:
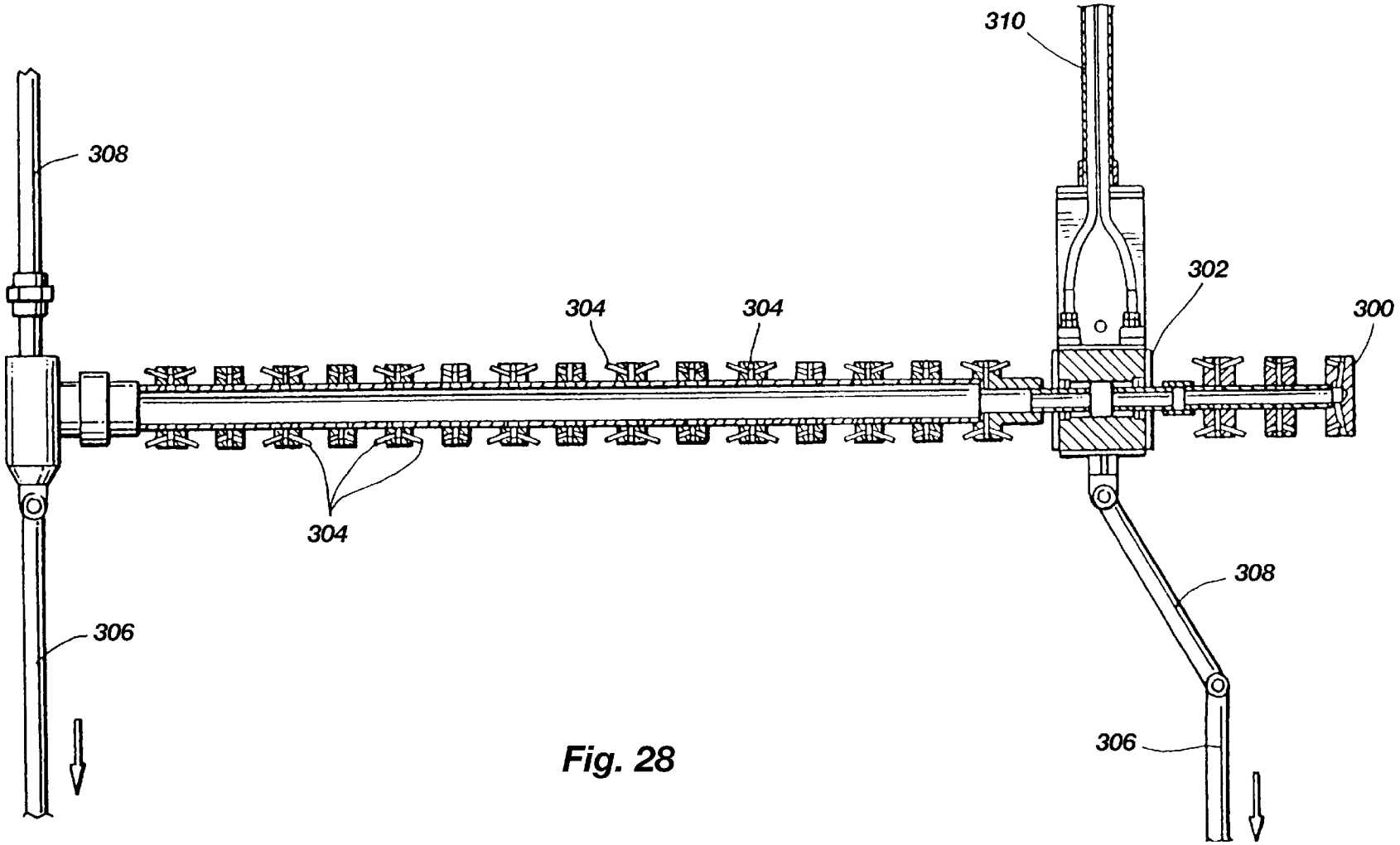
FIG. 28 is an illustration of a particular embodiment of the rotating cutting apparatus of the present invention.

FIG. 28 shows an alternative embodiment of the cutting device of this invention comprising a reciprocating cutting or jetting bar 300. Jetting bar 300 may be equipped with a hydraulic motor 302 to rotate the cutting bar's shaft and thus turn jets 304. Pulling pipes 306 may be connected to a flexible linkage 308. Trailing pipes 308 serves as a supply line for the high pressure slurry which exits through jets 304 to cut the soil encountered during a pull. Trailing pipe 310 may comprise a hydraulic fluid supply line to feed hydraulic motor 302, a trailing supply line for introducing a low pressure, high density slurry to the cutting area (as, for example, in block heave field applications of the present invention), or both. It should be noted that the cutting bar 300 may extend wider than (or beyond the width defined by) the trailing pipes 308, 310 or by pulling pipes 306.

Figure 29:
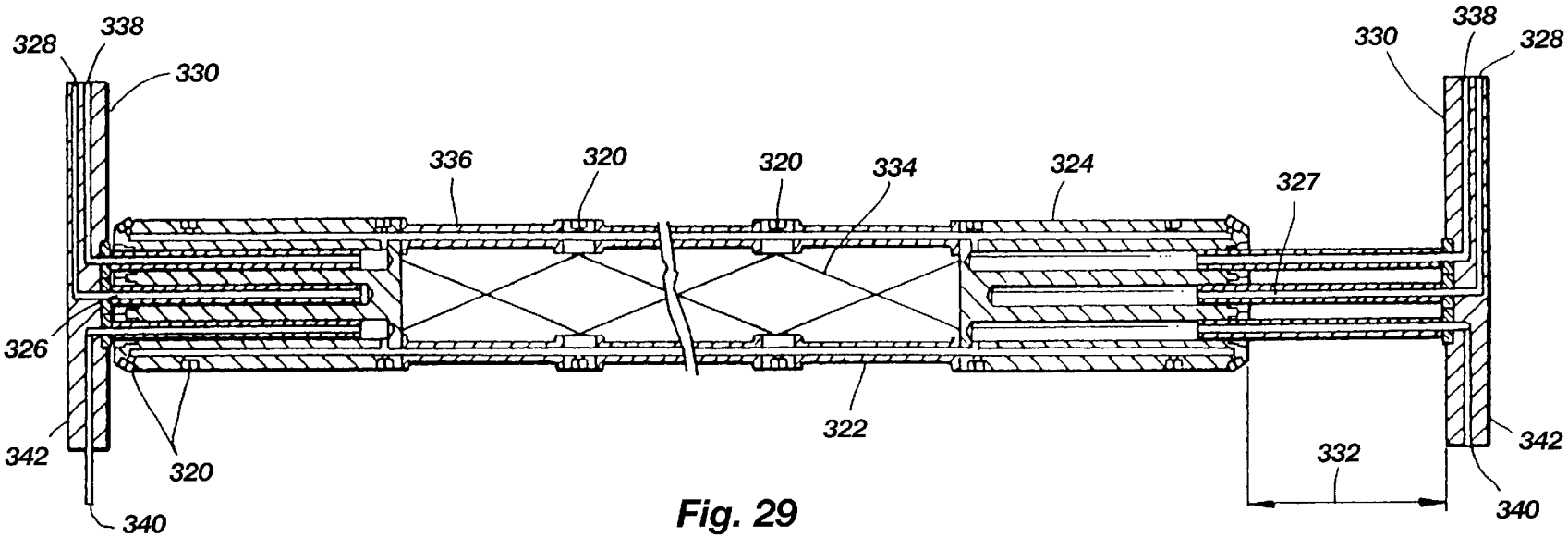
FIG. 29 is an illustration of a particular embodiment of the reciprocating cutting apparatus of the present invention.

FIG. 29 illustrates an embodiment of the reciprocating jet cutting bar of the present invention. Jetting subs 320 fed by slurry supply lines 340 of pulling pipe 342 are positioned along the front of jetting bar 322 which is part of reciprocating frame 324. Frame 324 reciprocates hydraulically from the alternating action of pistons 326, 327 connected to hydraulic fluid supply lines 328 positioned within trailing pipe 330. For example, as pressure is applied to the left piston 326, the frame 324 will slide or reciprocate to the right through a distance or stroke 332. The frame may be strengthened by including braces or stiffeners 334 between cutting bar 332 and rear cutting bar 336. Rear cutting bar 336 is also equipped with jetting subs 320 fed by trailing supply lines 338. If the reciprocating jet cutting bar should become lodged within the soil during operation, or for some reason the subs on cutting bar 322 become plugged, then the rear jetting subs on rear cutting bar 336 may be used to help free the cutter or back the cutter out of the barrier being formed.

Figure 30A:
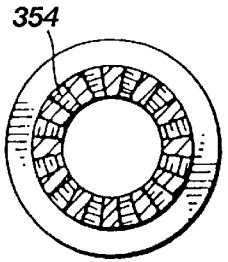
FIG. 30 is an illustration of an embodiment of a jetting sub used with the catenary cutting apparatus shown in FIGS. 20–23.
Figure 30B:
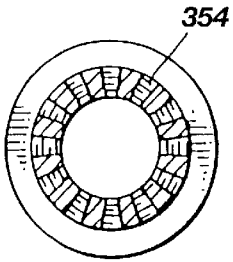
Figure 30:
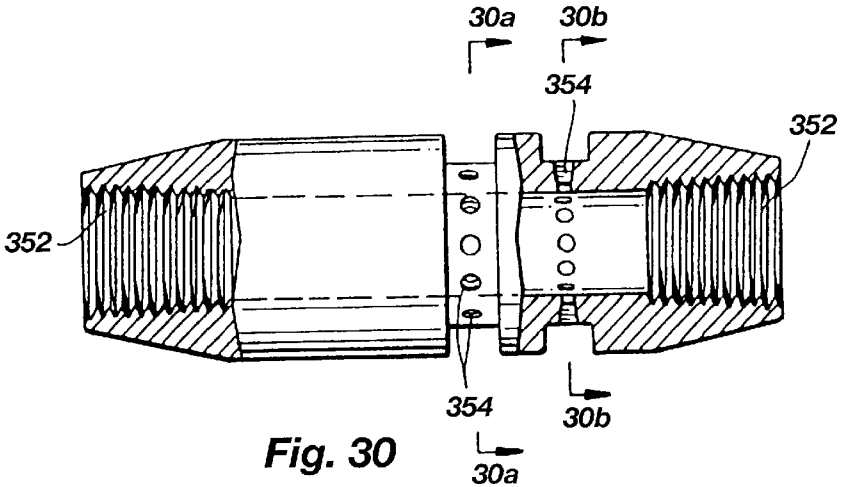

FIG. 30 illustrates an embodiment of a jetting sub which may be used with the catenary cutting apparatus of the present invention. Pipes are threadedly attached to both ends of jetting sub 350 having threads 352. Threaded holes or ports 354 extend around the circumference of the sub in a plurality of locations along the sub's length. Once the cutting device is assembled, either a plug or a nozzle is placed in each of these holes or ports 354 so as to define more accurately the direction in which cutting will take place. In other words, during on site assembly of the cutting device, the use of multiple holes, plugs, and nozzles permits easier alignment of the orifices through which the jetting fluid exits. As illustrated, each set of holes or ports 354 may be offset or rotated with respect to another set as a means of providing for angled jets during operation.

As shown in FIGS. 25 and 26, a hardenable cutting fluid or slurry is pumped into the jetting bar 256 and exits through one or more orifices 266 which accelerate the slurry to high velocity. In the preferred embodiment, a trailing pipe 260 delivers the slurry to the jetting bar 256 at a pressure of between about 1,000 psi and about 10,000 psi, preferably at about 5,000 psi. Slurry flows into the jetting bar 256 may be facilitated by a "live" swivel joint designed to rotate under high pressure. The fluid exiting the jetting bar impacts the soil with sufficient kinetic energy to disrupt and "liquify" the soil. The soil is thoroughly mixed with the exiting fluid.

As the parallel pipes 250 are pulled through the ground the jetting bar 256 liquifies the soil in its path and to each side to form a soil/cement slurry panel 264. After a complete pull, the jetting bar 256 has been pulled through the soil from one side of a waste site to another, and a hardenable panel 268 has been formed.

The trailing pipe 260, which is located within the formed panel 264, becomes one of the pulling pipes 250 used in forming the next panel 265. The next panel 265 can be formed by attaching the cutting device 256 to either end of the trailing pipe 260. In other words, the next panel 265 can be formed by starting on either side of the waste site. Use of the previous panel's slurry supply line (trailing pipe) to serve as the pulling pipe for the next panel helps ensure that the panels are joined along their length, even where the spacing between the pipes varies considerably. By linking one or more panels together in this manner, a continuous containment barrier is formed.

The tracking method of the present invention recently was field tested using a 9 foot wide jetting bar with 60 jets of cement slurry at 3000 psi. Groups of generally horizontal panels 150 feet long were formed. Panels were also joined at angles to form an accordion-like containment barrier. Such structures were formed by placing every other tracking pipe or rib deeper than the nominal depth of the panel. The structures effectively minimized thermal expansion dimensional change effects. In forming vertical walls, these same effects can be minimized by forming the wall along a serpentine or zig-zagging path.

Figure 31:
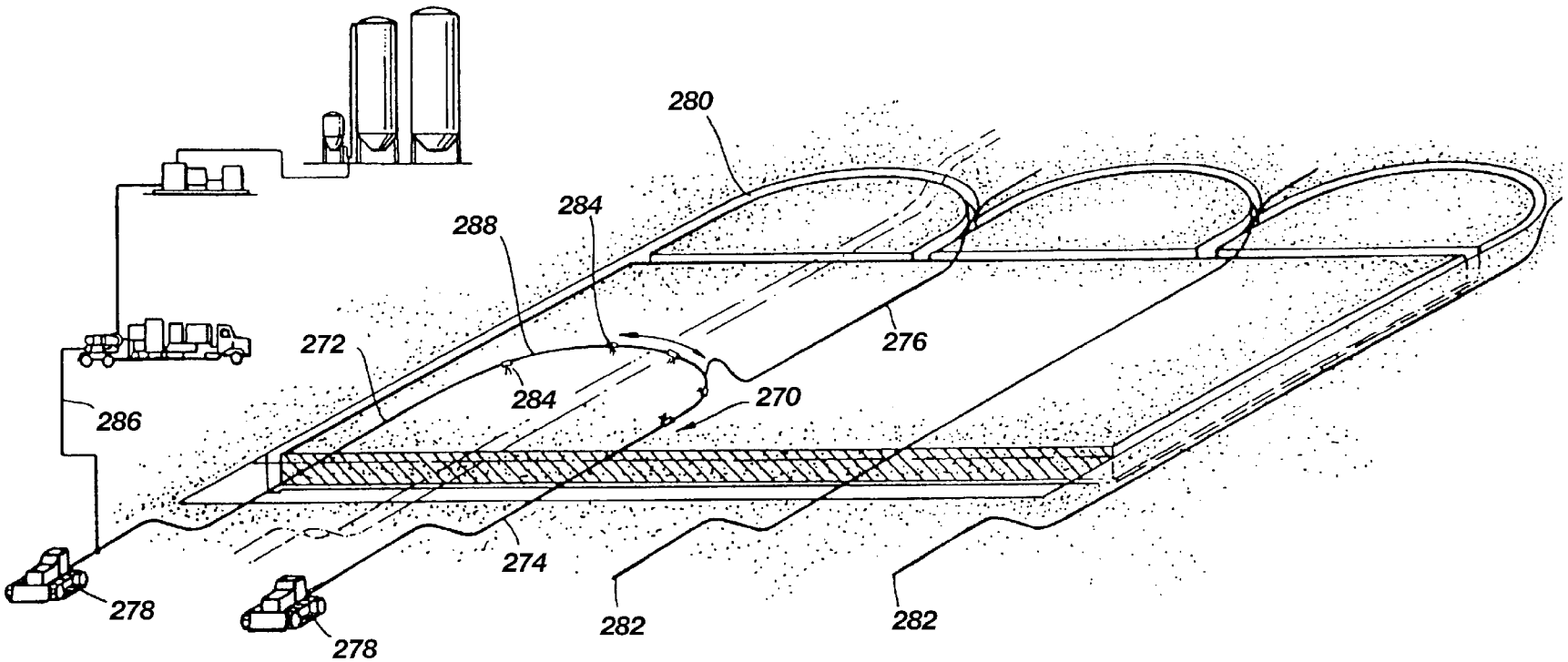
FIG. 31 is an illustration of a particular embodiment of the present invention suitable for forming large containment barriers using the catenary cutting apparatus of the present invention.

As shown in FIG. 31, with the present invention continuous panels can also be formed with the catenary jetting bar. On one side of a waste site one end of the catenary bar 270 is attached to an end of pre-placed pulling pipe 272, and the other end of the bar 270 is attached to the end of adjacent pre-placed pulling pipe 274. At least one trailing pipe 276 is attached. Pulling means 278 are attached to the other ends of the pre-placed pipes 272, 274, and the catenary jetting bar 270 is pulled along and under the waste site. The soil under the waste site is cut either by pulling on both pulling pipes 272, 274 together, by advancing the pulling pipes 272, 274 in turn (i.e. pulling on the first pipe while not moving the second, then moving the second while not moving the first), or by any other combination of pulls sufficient to create the desired cutting action. When the pulling pipes 272, 274 are advanced in turn, the pulling pipe not being moved at a particular moment acts to maintain tension in the pulling pipe. In a complete pull, the catenary beam 272 will form a continuous barrier from one side of the waste site to the other.

The catenary cutting device 272 may be placed into shallow trench 280 generally spanning one side of the waste site at the start. The pulling pipes 272, 274 may be pre-placed under the site by directional drilling techniques. The catenary cutting method permits wider spacing of pre-placed pulling pipes 282. In the preferred embodiment, pre-placed pulling pipes 282 are substantially parallel and spaced about 200 feet apart.

The pulling pipes 272, 274 typically are loosely attached to and reciprocated by earth moving equipment or other means 278 with a stroke approximately equal to the spacing between jet subs 284. Preferably, a 30–50 foot stroke is used. One or both of the pulling pipes 272, 274 connect to a high pressure slurry line 286 at the end with the reciprocating apparatus 278. The slurry lines 286, pulling pipes 272, 274, and catenary pipe 288 preferably feed a cement based slurry or other hardening liquid to the jetting subs to liquify the soil in front of the catenary beam or cutting device. The trailing pipe 276 also may be used as a slurry supply line. Preferably, the slurry provided to the jetting subs helps lubricate the cutting device.

In forming multiple joined panels a length of trailing pipe 276 may be attached to the point where pulling pipe 274 and the catenary beam 288 meet by means of a long chain or cable. Such an arrangement allows the catenary beam to stroke freely and also helps to ensure that the trailing pipe is in position to be one of the two pulling pipes needed to form the next panel.

With the present invention it is possible also to form multiple barriers under previously formed barriers, in effect creating a multilevel containment system. Leachate detection and collection of pipes may be installed in the space between such layers. In the case of a conventional double lined landfill where the first liner is found to be leaking, a new third barrier liner and leachate collection system may be created in situ under the existing liners to bring the landfill back into regulatory compliance.

The jetted cutting fluid or slurry for the barrier forming process of the present invention may be any pumpable fluid or slurry. For the purpose of forming barriers the slurry is preferably a combination of one or more of the following: any type of cement, bentonite or other clays, flyash, kiln dust, lime, slag cement, silica fume, or other cementitious products with admixtures such as latex polymers, weighting agents such as fiber reinforcing additives, weight increasing additives (such as iron oxide), water reducing admixes such as are used in concrete and oil well cement, anti-air entrainment additives, cement retarders, cement dispersants, cement anti-dewatering (fluid loss) additives, and additives which enhance or reduce the thixotropic properties of such slurries. Other barrier materials, such as hot wax, asphalt, sodium silicate grout, polyacrylamide grout or other hardening materials, could also be employed.

It is generally desirable to use a slurry which is designed to produce a slurry/soil mixture which will have an equal or greater density than the overburden soil. This helps prevent subsidence of the overburden formation which could pinch out the slurry to form a "window" in the barrier. Generally, a "window" is any imperfection in a containment barrier which permits containments to leak or migrate into areas the barrier is intended to protect.

As taught in copending U.S. application Ser. No. 07/774,015 filed Oct. 7, 1991, this slurry may also be made very heavy while retaining its fluidity so as to initiate a high displacement block heave. Such a slurry is preferably composed primarily of iron oxide powder with lessor amounts of cement and finely divided fumed silica. Water reducing admixtures and latex polymer additives enhance ductility, and reduce permeability. Bentonite, latex polymers, or fibrous materials may be added to increase ductility and impart resistance to crack growth. Since the bulk of this slurry may be pumped into the cut at low pressure and need not pass through jets, reinforcing synthetic or metal fibers also may be used. Use of a sufficiently dense slurry results in upward forces on the soil which heave the land surface upward as the thickness of the barrier increases. This effect may be very desirable, for instance, since a horizontal cut made with a narrow three inch bar may be expanded to several feet thick. This heave effect also provides some assurance that panels formed by the jetting bar are fully continuous with adjacent panels. The visible surface heave will also contribute to the marketing appeal and commercial success of the process since with this method it will be apparent that a barrier of substantial thickness has been created. If a block of land is lifted several feet by such a slurry a bar or a pipe may be passed under the waste site before the panels have fully hardened to show that the containment barrier is continuous. A slurry capable of creating the desired block heave effect may be introduced to a barrier in numerous ways. For instance, the slurry may be used to cut the soil around and under a site and form the barrier; the slurry may be added to a barrier as the barrier is formed with a different cutting fluid (e.g. by being supplied by a trailing pipe to a low pressure jet attached to a cutting device); or the slurry may be added to a trench intersecting the barrier and permitted to flow around and under the site.

While the present invention is particularly useful for forming impermeable containment barriers, it is also possible to use the apparatus and methods disclosed herein in forming other types of structures. For example, to form a permeable pathway rather than a containment barrier the invention could be practiced with a temporary water gelling agent, (such as a guar gum), or gelled acid mixed with a fine sand or other "propping" agent to produce a permeable horizontal pathway through a formation for the purpose of collecting contaminated liquids. In addition, it is also contemplated that the apparatus and methods of the present invention can be used to homogenize soil in situ. The present invention may use the principles of the falling beam cutting device to mix and blend large blocks of soil into a very uniform paste of slurry admixture and soil. It is anticipated that such a machine will be capable of processing soils up to 25 feet deep at rates of over 220 cubic yards per hour with more intimate mixing than is possible in pug mills. Previous in situ soil blending systems based on a large drill or auger systems can achieve soil blending rates of only about 40 cubic yards per hour due in part to the significant energy losses that occur with such systems. These previous systems also require a huge crane which is expensive to mobilize. In field trials involving the present invention, slurries were mixed with soils at ratios less than three to one and at speeds of up to 140 cubic feet per minute using a 900 hp pumping unit. With the present invention more energy actually reaches the soil than with previous soil-blending systems. The horsepower to form the barrier is transferred to the underground work face by means of the potential energy of the high pressure fluid inside of the pipe. This pressure is converted to kinetic energy of velocity as it accelerates through the jets and into the face of the soil to be cut. Thus, the energy is transferred efficiently.

By forming barriers much wider than 12 inches, the present invention may be used to blend or process larger tracts of soil. Further, the present invention also may be used to airstrip soil by jetting superheated steam into the soil. Jetting a jelled water with time delayed breaker (as in oil well fracturing) could be useful in installing interceptor drains and bio-polymer trenches. The present invention also may be used to lay pipelines in soil below the water table. Sludge ponds may be solidified and bio-remediation agents can be introduced into the soil with the present invention.

Figure 32:
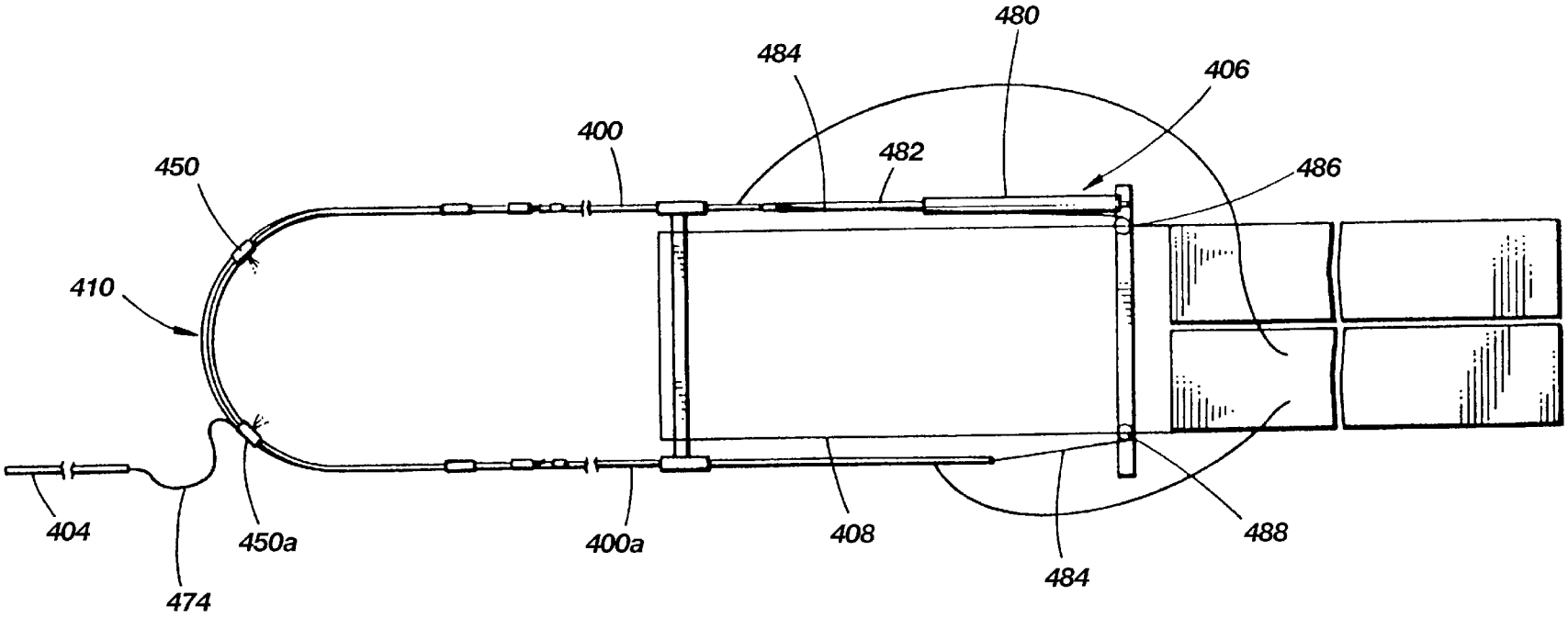
FIG. 32 is an illustration of a particular embodiment of the present invention suitable for forming long generally horizontal barrier panels using a reciprocating arcuate-shaped cutting apparatus.

An apparatus for forming a horizontal containment barrier according to the present invention is shown in FIG. 32. In this embodiment, a panel is formed by pulling a pair of parallel pipes 400, 400*a*, each having a leading end and a trailing end, through the ground. A cutting device 410 is attached between the trailing ends of the pipes 400, 400*a* which cuts a path between the tracks of the two pipes. The cutting device 410 resembles the cutting device 256 in that it ejects into the soil a high pressure slurry mixture to facilitate the cutting process. The cutting device 410 includes a reciprocating catenary or arcuate-shaped member, explained in greater detail below.

To aid in forming the next adjacent panel, one or more trailing pipes 404 are pulled through the freshly blended soil behind the cutting device 410. The trailing pipes 404 may serve as supply lines for the permeability modifying slurry or other cutting fluids used by cutting device 410. Preferably, once a "pull" is complete, trailing pipes 404 become the "pulling pipes" used in forming an adjacent panel. The advantages of this tracking method have been fully explained above.

Figure 33:
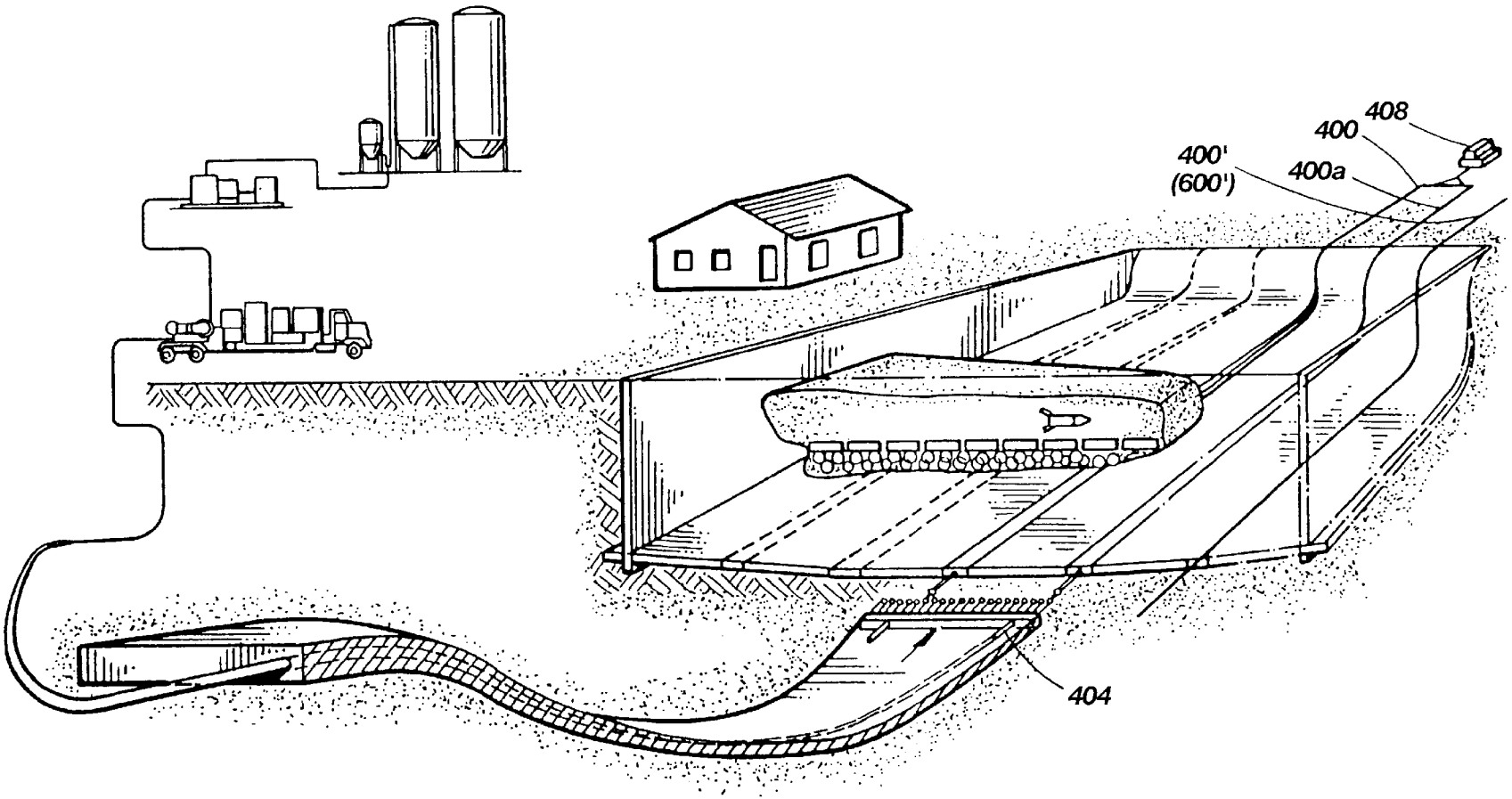
FIG. 33 is an illustration of the formation of a containment barrier under and around a waste site using a preferred embodiment of a cutting and barrier forming apparatus according to the present invention.

The pipes 400, 400*a* generally are uniformly spaced apart a distance of between 5 and 100 feet all along their lengths. In the preferred embodiment, the pipes 400, 400*a* are spaced 10 feet apart and parallel to one another. Preferably, the pipes 400, 400*a* are 2⅜" O.D. steel oil well tubing or other tubing which can make desired curves elastically without permanent deformation and which are capable of handling internal fluid pressures up to 15,000 psi (lbs/in$^2$). The pipes 400, 400*a* are preferably placed under the site to be contained by directional drilling techniques, which are well known in the art, as shown in FIG. 33.

A reciprocating means 406 is attached to the leading ends of the pipes 400, 400*a*, as shown in FIG. 32. The reciprocating means 406 pulls the parallel pipe 400 in a forward direction, i.e., to the right in FIG. 32, a given distance causing that portion of the arcuate-shaped cutting device 410 near the trailing end of pipe 400 to move forward. At the same time, the pipe 400*a* may move backward, i.e., to the left in FIG. 32. The reciprocating means 406 then pulls the pipe 400*a* in the forward direction causing that portion of the arcuate-shaped cutting device 410 near the trailing end of pipe 400*a* to move forward. Pipe 400 at the same time may move in a backward direction.

Each time one pipe 400, 400*a* is pulled forward and the other pipe 400, 400*a* is recoiled backward, one stroke takes place. Thus, by reciprocating the arcuate-shaped cutting device 410 repeatedly, i.e., through multiple strokes, the soil is cut, in much the same way that an arc-shaped or string saw alternately pulled at each of its ends may be used to cut a tree limb.

In the preferred embodiment, where the pulling pipes 400, 400*a* are approximately 10 feet apart, the preferred stroke length is about 8 feet. That is, each time that one of the pulling pipes 400, 400*a* is pulled by the reciprocating means 406, the trailing end of each pipe 400, 400*a* advances a linear distance of 8 feet. The reciprocating means 406 preferably cycles through 20 strokes per minute.

The reciprocating means 406 is connected to a pulling means 408, as shown in FIG. 32. The pulling means 408 pulls the reciprocating means 406, the pipes 400, 400*a,* and the arcuate-shaped cutting device 410 through the soil. The pulling means 408 preferably advances at a linear speed of about 3 ft/min resulting in the soil being cut and a panel of barrier wall being formed at a similar rate of about 3 ft/min. One or more dozers, backhoes, earth moving machines, other vehicles, winches or other such devices may be used as the pulling means 408.

Figure 34:
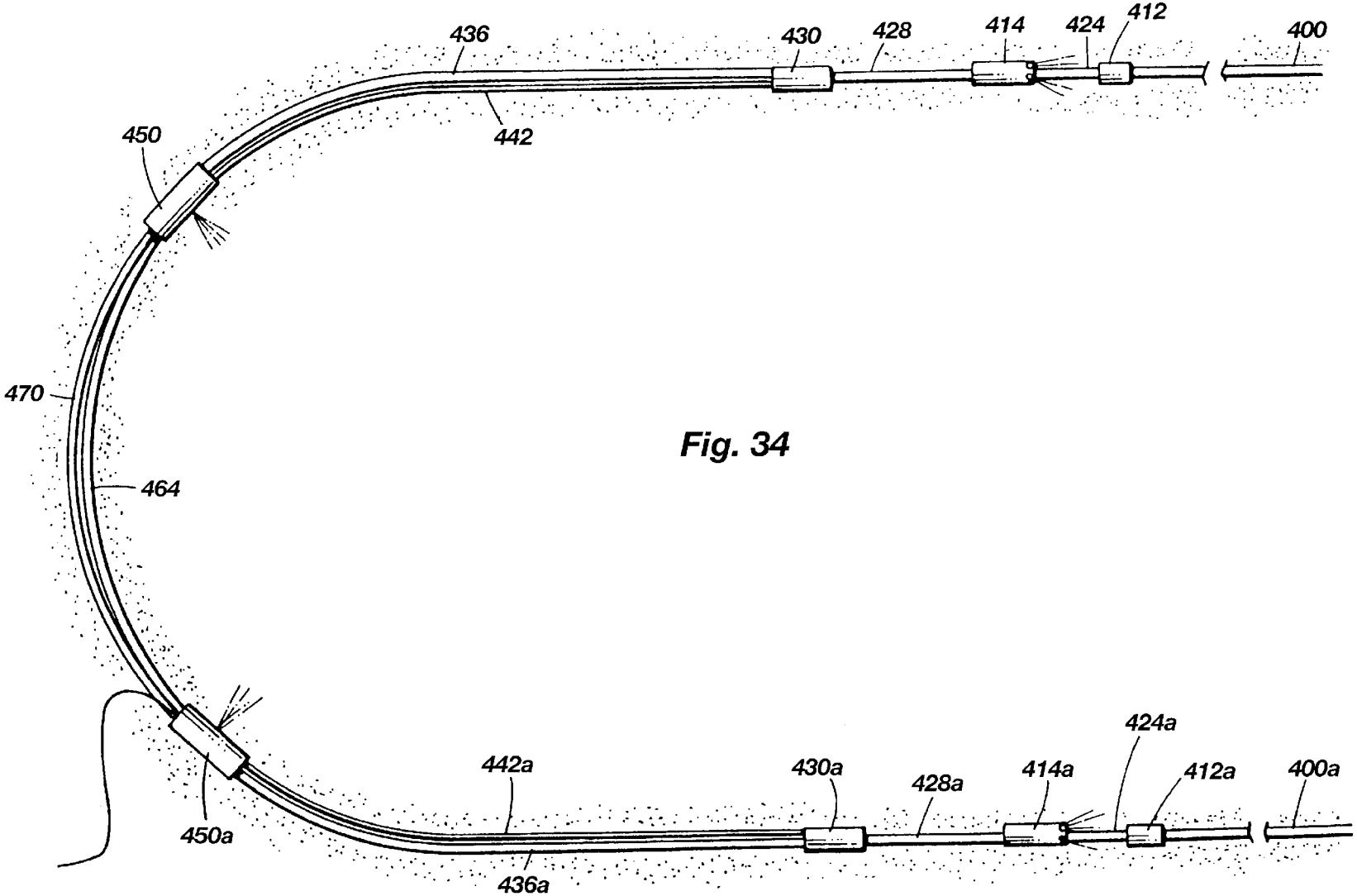
FIG. 34 is a top view of the reciprocating arcuate-shaped cutting apparatus shown in FIG. 32.

Union couplings 412, 412*a* attach cutting device 410 to the trailing ends of pipes 400, 400*a,* as shown in FIG. 34. Hole widening subs 414, 414*a* are disposed near each end of the cutting device 410. The hole widening subs 414, 414*a* help widen the hole in which the pulling pipes 400, 400*a* travel, thus promoting advancement of the cutting device 410 through the soil. The widening preferably is accomplished by ejecting a high pressure slurry mixture through one or more jets 416, 418 (shown in FIG. 35). The jets 416, 418 generate streams of the high pressure slurry which preferably exit the hole widening subs 414, 414*a* at acute angles from one another. The exiting slurry disrupts and erodes the soil near the hole widening subs 414, 414*a* to facilitate passage of the cutting device 410. The jets 416, 418 are supplied with high pressure slurry through a conduit 420.

Figure 35:
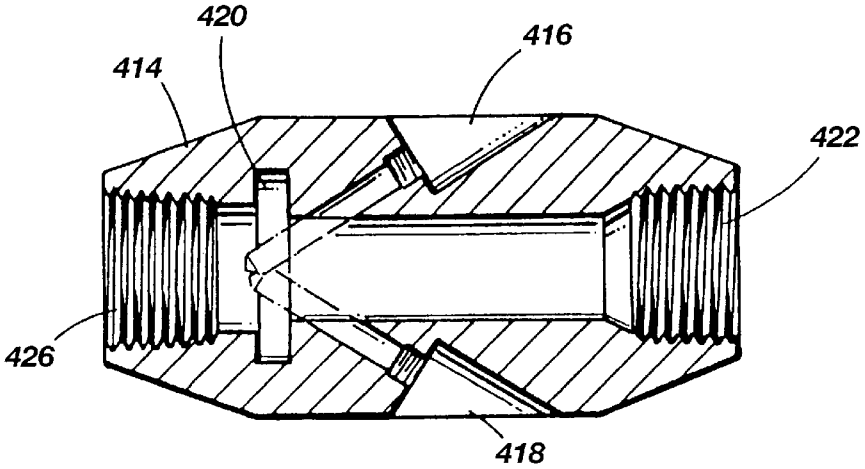
FIG. 35 is a cross-sectional view of a hole widening sub used with the reciprocating arcuate-shaped cutting apparatus shown in FIG. 34.

Each hole widening sub 414, 414*a* has a coupling 422 at one end to which coupling pipes 424, 424*a* attach, as shown in FIGS. 34 and 35. The coupling pipes 424, 424*a* connect the cutting device 410 to the trailing ends of the pulling pipes 400, 400*a* via the union couplings 412, 412*a*. The coupling pipes 424, 424*a* receive slurry from pipes 400, 400*a* and supply it to the jets 416, 418 via conduit 420, as shown in FIG. 35. The coupling pipes 424, 424*a* are preferably 2⅜" O.D. steel oil well tubing.

Figure 36:
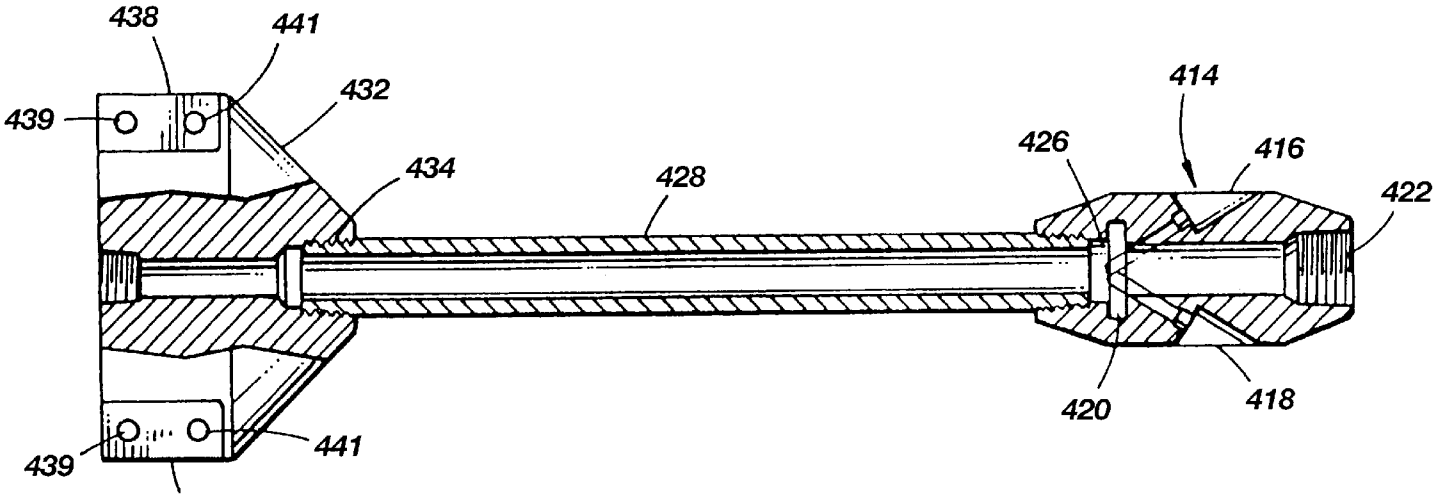
FIG. 36 is a cross-sectional view of the hole widening sub shown in FIG. 35 connected to a spring sub used with the reciprocating arcuate-shaped cutting apparatus.

Each hole widening sub 414, 414*a* has a coupling 426 at its other end for attaching a connecting pipe 428, as shown in FIG. 36. The connecting pipes 428, 428*a* are preferably 2⅜" oil well tubing, the same as that used in the coupling pipes 424, 424*a* and the pulling pipes 400, 400*a*.

The cutting device 410 further comprises a pair of spring subs 430, 430*a,* as shown in FIG. 34. Preferably, each spring sub 430 is formed of a plate 432, as shown in FIG. 36, and tubular member having couplings on each end. As shown in FIG. 36, the coupling 434 couples the spring sub 430 to the connecting pipe 428 at one end. The other end of the spring sub 430 is connected to supply hose 436. Slurry is supplied to the supply hoses 436, 436*a* through the pulling pipes 400, 400*a*. The slurry is preferably filtered before it is pumped through the pulling pipes 400, 400*a*. The supply hoses 436, 436*a* are preferably 1¼" I.D. steel reinforced rubber hose capable of handling internal pressures up to 5,000 psi.

The plate 432 preferably is oriented in the vertical direction, i.e., its planar surface generally is perpendicular to the ground surface. The plate 432 includes spring mounting means 438 and 440 disposed near the top end and bottom end of the plate, respectively. Each spring mounting means 438, 440 preferably includes two mounting holes 439 and 441, as shown in FIG. 36, through which bolts or rivets may be disposed to couple the spring to the plate 432.

Figure 37:
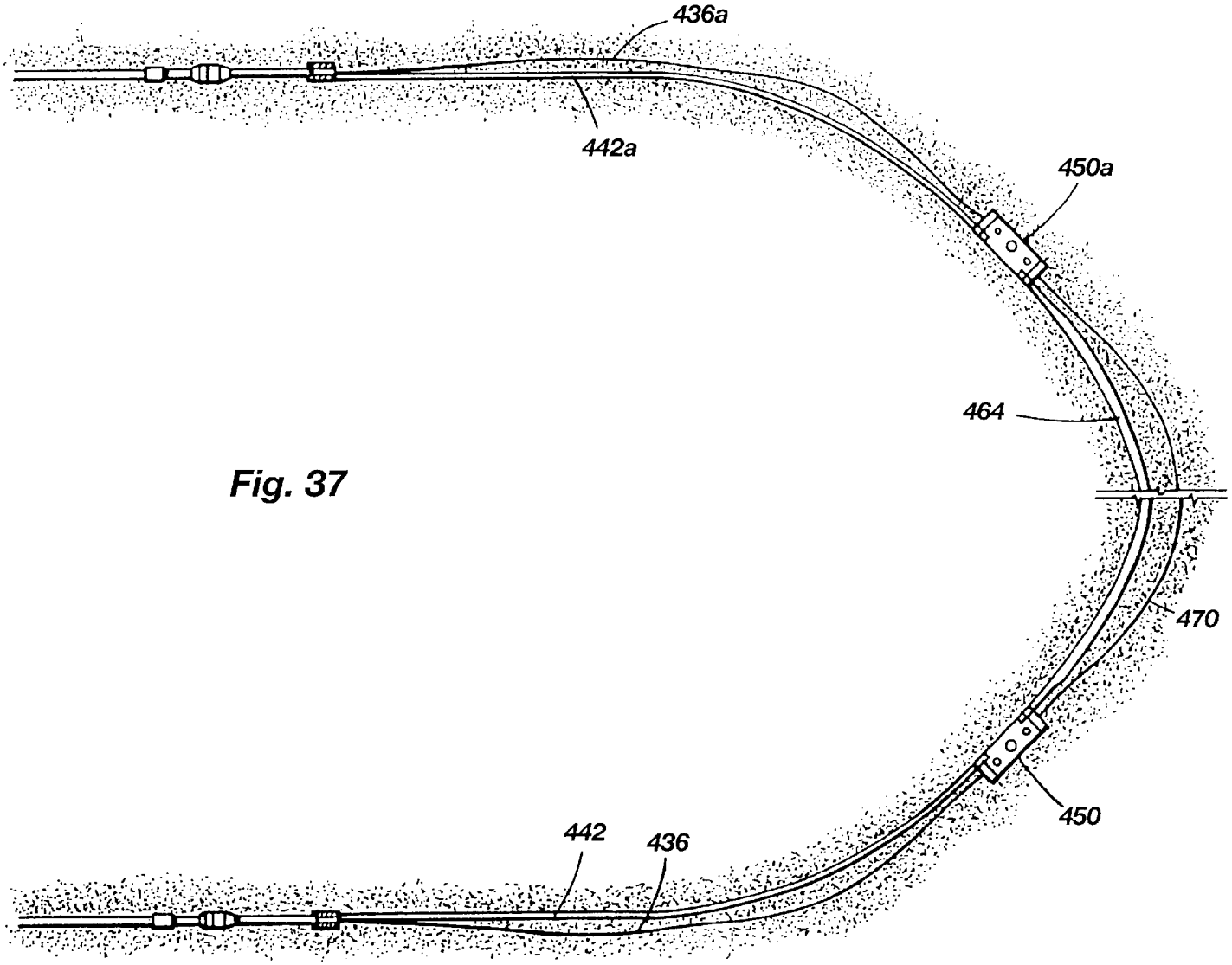
FIG. 37 is a top view of another illustration of the reciprocating arcuate-shaped cutting apparatus shown in FIG. 32.

The cutting device 410 further comprises a pair of springs 442, 442*a,* each having two ends, as shown in FIG. 37. One end of each of the springs 442, 442*a* is coupled to the spring mounting means 438 and 440, respectively. The springs 442, 442*a* are preferably formed of a plurality of overlapping strips of steel, each of which is preferably 0.93" thick and 2.5" wide. Preferably, 3 to 4 strips of such steel are overlapped to form the springs 442, 442*a* in an apparatus used to form 10' wide panels.

Figure 38:
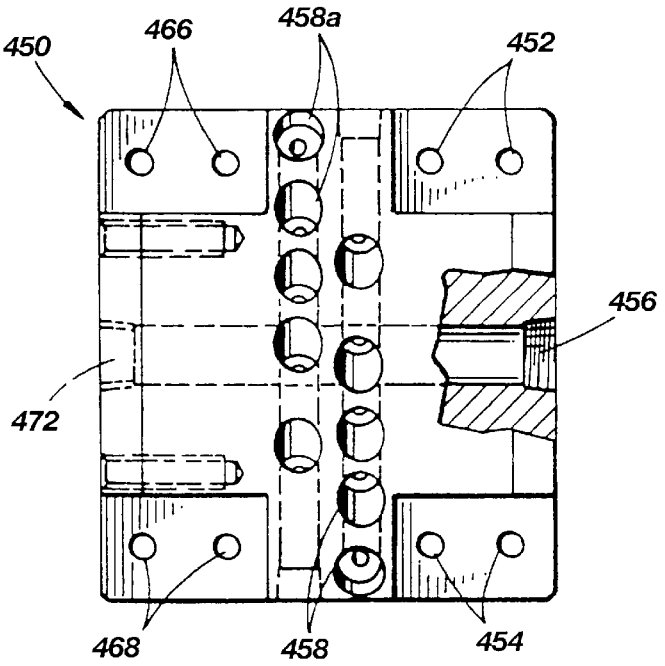
FIG. 38 is a cross-sectional view of an embodiment of a jetting sub used with the reciprocating arcuate-shaped cutting apparatus shown in FIG. 32.
Figure 40:
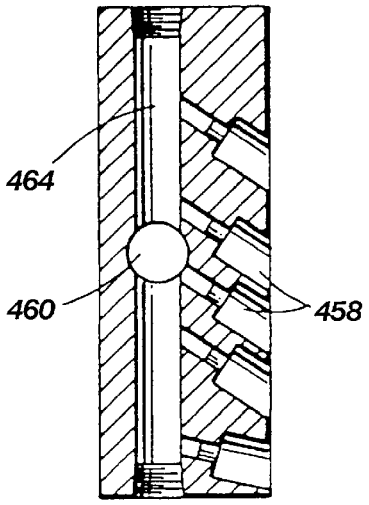
FIGS. 40 and 41 are cross-sectional views of two columns of divergently directed jet ports used in the jetting sub shown in FIG. 38.
Figure 39:
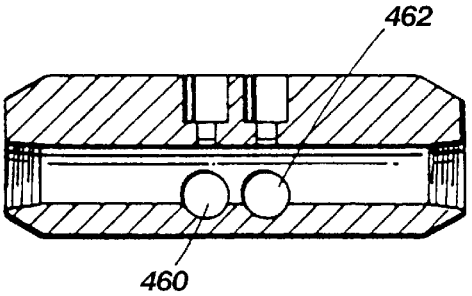
FIG. 39 is a cross-sectional view of a pair of conduits for supplying a slurry mixture to the jetting sub shown in FIG. 38.
Figure 41:
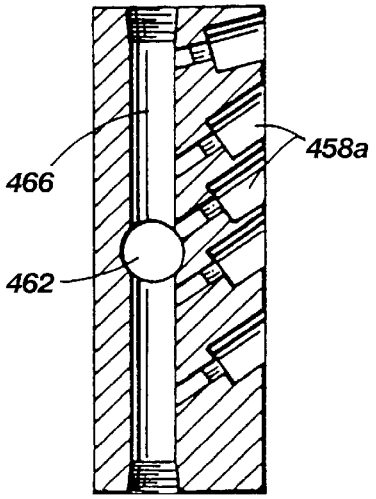

The supply hoses 436, 436*a* and the springs 442, 442*a* connect to a pair of jetting subs 450, 450*a,* as shown in FIG. 37. Preferably, each jetting sub 450 has mounting holes 452 and 454 for attaching springs 442, 442*a,* as shown in greater detail in FIG. 38. Each jetting sub 450 further includes a coupling 456 to which supply hose 436 is attached, as shown in FIG. 38. The supply hose 436 supplies slurry through a conduit to a plurality of jet ports 458, 458*a,* as shown in FIG. 38. The slurry is supplied from the supply hose 436 to the jet ports 458, 458*a* through conduits 460 and 462, as shown in FIG. 39. The conduits 460 and 462, respectively, transport the slurry mixture into channels 464 and 466, respectively, which supply the plurality of jet ports 458, 458*a,* as shown in FIGS. 40 and 41.

The jet ports 458, 458*a* preferably are arranged in two columns, as shown in FIG. 38. The jet ports 458 in the right hand column shown in FIG. 38 spray the slurry outward and downward. The jet ports 458*a* in the left hand column spray the slurry outward and upward, The jet ports 458, 458*a* preferably spray the slurry mixture so that there is some overlap of the streams exiting the jet ports 458 and 458*a*.

Preferably, approximately 35 horsepower is supplied to each jet port; the streams exiting the jet ports 458 exit at an acute angle from the streams exiting the jet ports 458*a;* and there are five jet ports in each column. However, as a person of ordinary skill in the art will appreciate, the exact number of heads and their angle of orientation can be varied depending upon the circumstances of the particular application involved.

An arcuate member 464 is connected to the other ends of each of the jetting subs 450, 450*a,* as shown in FIG. 37. The arcuate member 464 is mounted to the jetting sub 450 at mounting holes 466 and 468, as shown in FIG. 38. The arcuate member 464 is preferably a locally rigid spring which is 2" wide by 2" thick and 8' long, corresponding to the preferred 8' stroke used in the embodiment which generates 10' wide panels. However, in an apparatus used to make 70'–100' wide panels, the spring 464 would preferably be a more flexible pipe.

A joining supply hose 470 may be coupled between jetting subs 450 and 450*a,* as shown in FIG. 37. The connection would take place at a coupling 472, shown in FIG. 38. Since the jetting subs 450 and 450*a* are individually supplied by supply hoses 436, 436*a,* it is not necessary that they be linked to each other by the joining supply hose 470. If no joining supply hose is used, the openings 472 are preferably capped. Use of a joining supply hose 470, though, is preferred as it allows for one continuous supply line of slurry to jetting subs 450, 450*a*.

The jetting subs 450 and 450*a* are reciprocated through an arcuate path by the reciprocating means 406 and advanced by the pulling means 408. As the jetting subs 450 and 450*a* are reciprocated the soil is cut. Ejected slurry disrupts and mixes with the soil to form a mixture which hardens to form a containment barrier or panel. Preferably, the panel formed is 12 inches deep by 10 feet wide, and extends from one side of a waste site to the other. The details of how the soil is cut and the barrier material is formed is explained in full above.

The trailing pipe 404 preferably travels behind cutting device 410, as shown in FIG. 32. The trailing pipe 404 preferably comprises the same material used for the pulling pipes 400 and 400*a,* i.e., 2⅜" O.D. steel oil well tubing. As with the embodiment shown in FIGS. 25 and 26, once a first "pull" is complete and a first panel is formed, the trailing pipe 404 becomes a pulling pipe 400' used to pull the cutting device 410 through the soil to form a second panel integrally formed with the first, as shown in FIG. 33. This tracking method, as described above, helps ensure that the edge of each new panel begins within the confines of the previous panel, thus forming a continuous containment barrier.

The trailing pipe 404 preferably is connected to the cutting device 410 at the jetting sub 450*a* by a chain or flexible cable 474, as shown in FIG. 32. The cable 474 should have sufficient length to allow the jetting sub 450*a* to move through its arcuate path. The trailing pipe 404 is advanced through the subsurface soil with the cutting device 410 by the pulling action generated by the pulling means 408.

The reciprocating means 406 preferably includes a hydraulic cylinder 480 mounted to the pulling means 408. The hydraulic cylinder 480 has a piston 482 attached to the leading end of pulling pipe 400, as shown in FIG. 32. A cable 484 is coupled at one end to the piston 482. Cable 484 loops around pulleys 486 and 488, which are also mounted to the pulling means 408, and connects at its other end to the leading end of the pulling pipe 400*a,* as shown in FIG. 32.

As the piston 482 of the cylinder 480 is retracted, it pulls the leading end of the pipe 400 forward. Simultaneously, the cable 484 allows the leading end of the pipe 400*a* to move backward, i.e., to the left in FIG. 32. As the piston 482 of the cylinder 480 is extended, it pushes the leading end of the pipe 400 to which it is attached backward. Correspondingly, tension in the cable 484 is created pulling the pipe 400*a* forward.

The hydraulic cylinder 480 reciprocates back and forth in turn moving the pipes 400, 400*a* in a continuous back and forth motion causing each of the jetting subs 450 and 450*a* to travel through arcs or curved paths of preferably 8 feet corresponding to the length of one stroke. The combination of the cuts by both jetting subs 450 and 450*a* thus creates the transverse cut corresponding to the width of the panel, which in the preferred embodiment is 10 feet.

Figure 32A:
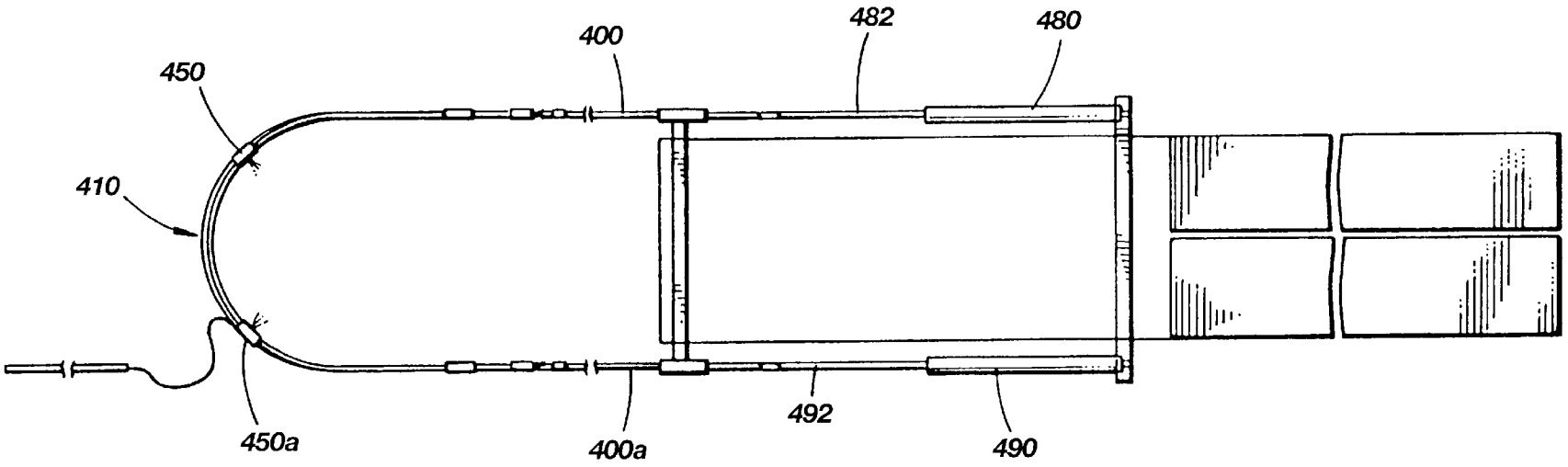
FIG. 32A is an illustration of an alternate embodiment of a means for reciprocating the arcuate-shaped cutting apparatus shown in FIG. 32.

In another preferred embodiment shown in FIG. 32A, the reciprocating means 406 comprises two hydraulic cylinders 480 and 490 each having a respective piston 482 and 492. The piston 482 is attached to the leading end of the pulling pipe 400, and the piston 492 is attached to the leading end of the pulling pipe 400*a*. As the cylinder 490 is extended it pushes the leading end of pipe 400*a* backward. At the same time, the piston 482 of the cylinder 480 is retracted to pull the leading end of pulling pipe 400 forward. During the next stroke the leading end of pulling pipe 400*a* is pulled as the piston 492 retracts into the cylinder 490, and the leading end of the pulling pipe 400 is pushed by the piston 482 as it extends outward from the cylinder 482.

Figure 42:
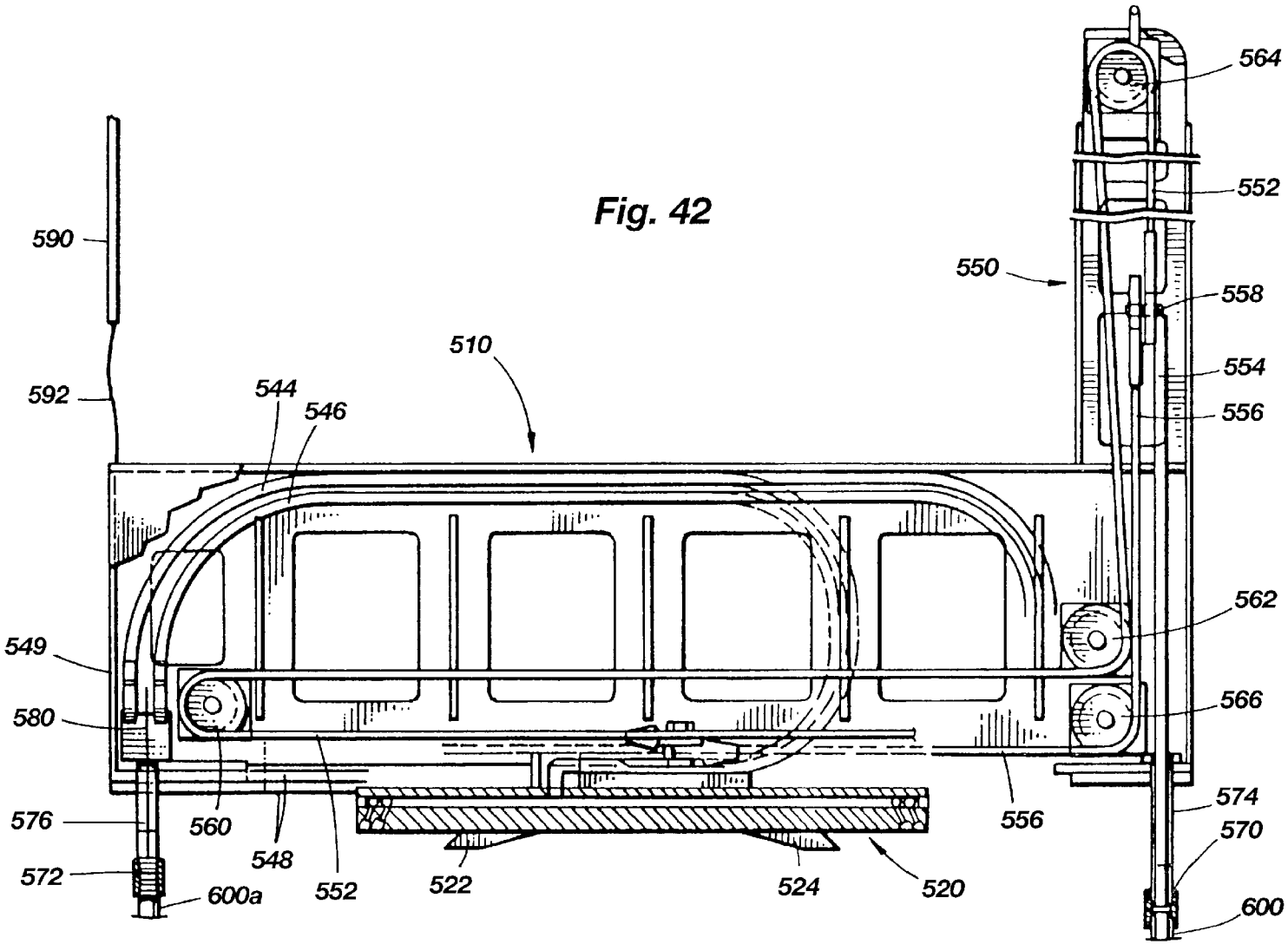
FIG. 42 is an illustration of an alternate embodiment of the present invention suitable for forming long generally horizontal barrier panels using a transversely reciprocating cutting apparatus.
Figure 43:
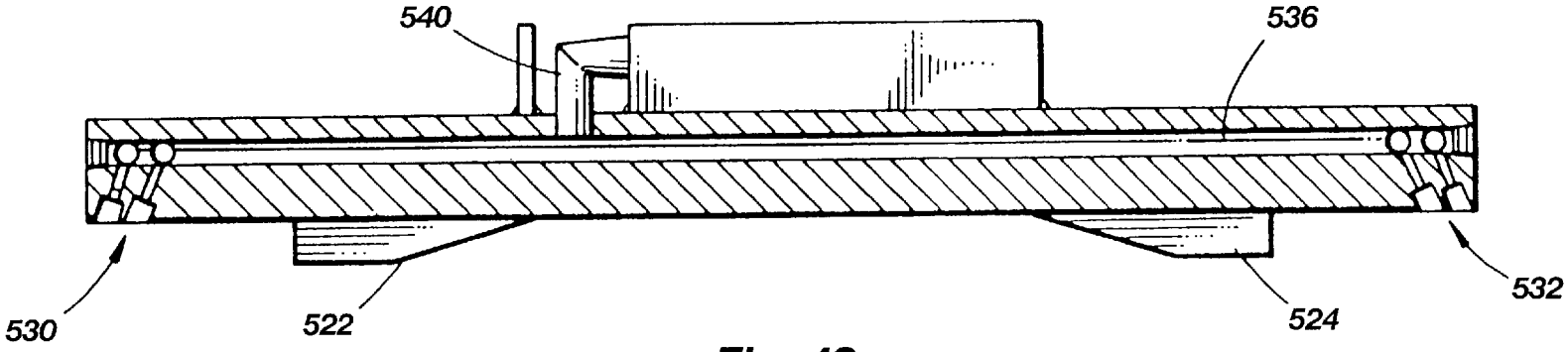
FIG. 43 is a top view of an embodiment of a jetting head used with the transversely reciprocating cutting apparatus shown in FIG. 42.
Figure 44:
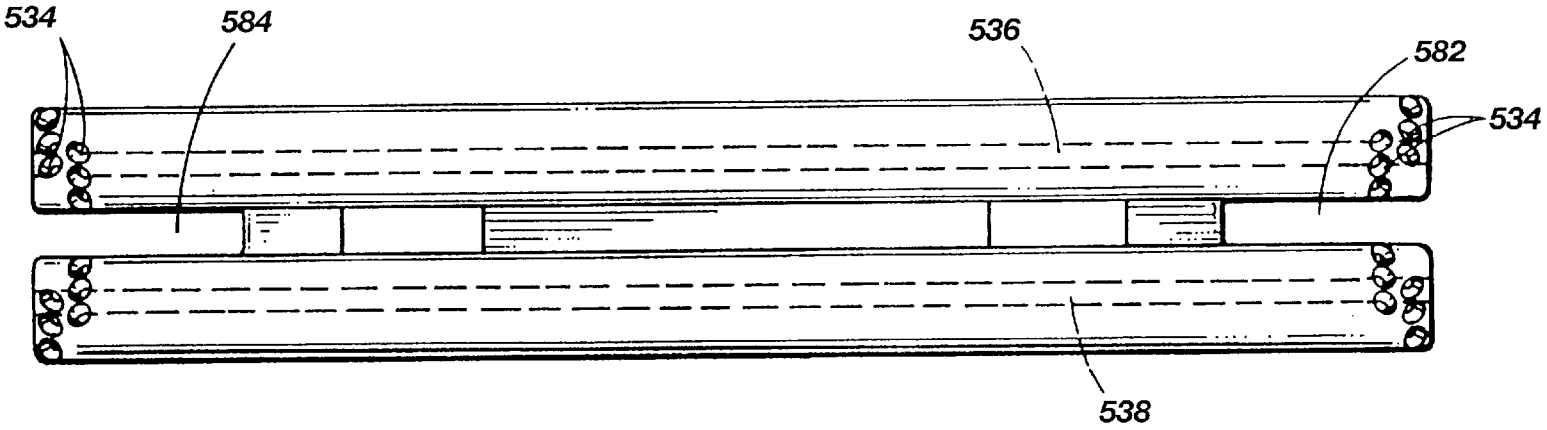
FIG. 44 is a front view of the jetting head shown in FIG. 43.

Another embodiment of a horizontal barrier producing apparatus is shown in FIGS. 42–44. The cutting device 510 comprises a single jetting head 520 having jet orifices near each of its ends. The jetting head 520 reciprocates back and forth across the leading portion of the cutting device through the action of a plunger and pulley arrangement 550.

The jetting head 520 is preferably formed of a steel member which is 5" thick and 5' long and weighs approximately 1,000 lbs. Cutters 522 and 524 are attached to the leading edge of the jetting head 520 near its ends, as shown in FIG. 42. Each cutter is approximately 1½" wide and ¼ thick and is formed of steel. Preferably, each cutter has a hard-faced material welded to it. The cutters 522 and 524 facilitate cutting of subsurface obstacles such as rocks, tree roots, or debris.

Jets 530 and 532 are disposed near the ends of the jetting head 520 and spray high pressure slurry toward the soil to be cut, as shown in FIGS. 42 and 43. Each of the jets 530 and 532 has a plurality of ports 534. Preferably twelve (12) such ports are arranged in two columns of six (6), as shown in FIG. 44. Each of the columns has an upper portion having three ports and a lower portion having three ports. The three jets in the upper portion of one of the columns sprays the slurry in an upward direction while the three ports in the lower portion of the column sprays the slurry in a downward direction. The three ports in the upper portion of the other column sprays slurry in the downward direction while the three ports in the lower portion of the other column sprays slurry in the upward direction. The streams from the upper and lower portions of the columns overlap forming a continuous stream which is preferably at least 1 foot wide. Of course, the exact configuration of the jets and ports can be varied according to the circumstances involved in a particular application.

Slurry is supplied to the jets 530, 532 through channels 536 and 538 which connect to a conduit 540, as shown in FIGS. 43 and 44. The conduit 540 is supplied with slurry from supply hoses 544 and 546 which in turn are supplied from pulling pipe 600*a,* as shown in FIG. 42. The supply hoses 544 and 546 are preferably 1¼" I.D. steel reinforced rubber hose capable of handling internal pressures up to 5,000 psi.

The jetting head 520 preferably rides on two brass rails 548 which are mounted to a frame 549 connected to pulling pipes 600, 600*a,* as shown in FIG. 42. The jetting head 520 reciprocates back and forth along the rails 548 by the action of the assembly 550.

The cable and pulley assembly 550 comprises a cable 552 which is coupled at one end to the jetting head 520 for pulling the jetting head to the left (as viewed in FIG. 42) and coupled at the other end to a plunger rod 554, as shown in FIG. 42. A cable 556 which is connected at one end to the jetting head 520 for pulling the jetting head to the right and connected at the other end to the plunger rod 554, as shown in FIG. 42. A turn-buckle coupling 558 is used to connect the cables 552 and 556 to the plunger rod 554. The cable 552 loops around pulleys 560, 562 and 564 and the cable 556 loops around pulley 566, generally situated on frame 549 as shown in FIG. 42.

The plunger rod 554 preferably comprises 1½" O.D. steel pipe disposed within pulling pipe 600 (which preferably is formed of 2⅜" O.D. oil well steel pipe) and connects to a reciprocating means at the leading end of the pulling pipe 600. The reciprocating means is preferably a hydraulic cylinder such as the ones shown in FIGS. 32 and 32A. The hydraulic cylinder reciprocates the plunger rod 554 back and forth within pulling pipe 600, as the piston of the hydraulic cylinder extends and retracts. The stroke distance for this reciprocating motion is preferably 70" used to form a 10' wide panel.

As the plunger rod 554 is stroked backward (toward the top of FIG. 42) in response to the piston of the hydraulic cylinder being extended. The cable 556 is pulled, creating tension in the cable 556 which pulls the jetting head 520 to the right as viewed in FIG. 42.

In the reverse operation, the plunger rod 554 is stroked forward (toward the bottom of FIG. 42) in response to the retraction of the piston into the hydraulic cylinder. This plunger action causes tension in the cable 552, pulling the jetting head 520 to the left as viewed in FIG. 42.

The back and forth movement of the plunger rod 554 created by the reciprocating means is thus translated into an oscillation of the jetting head 520 from one end of the frame 549 to the other. As the jetting head 520 travels back and forth, the action of the cutters 522 and 524 and the high pressure streams of the slurry exiting the jets 532 and 534 create a cutting action along the face of the soil.

Cutting device 510 is attached to the trailing ends of pulling pipes 600 and 600*a*. Couplings 570 and 572 couple extension pipes 574 and 576 disposed on each of the ends of the cutting device 510 to pulling pipes 600, 600*a*, as shown in FIG. 42. The extension pipes 574 and 576 may either be coupled to the housing 549 or integrally formed therewith.

As discussed above, the slurry mixture flows to the jetting head 520 through the supply hoses 544 and 546 which receive their supply of slurry via pulling pipe 600*a* from a supply source previously described. The slurry enters the supply hoses 544 and 546 through a flow divider 580 which is coupled to or integrally formed with the extension pipe 576.

The jetting head 520 preferably has cut-outs or grooves 582 and 584 formed in each of its ends, as shown in FIG. 44. The grooves 582 and 584 allow the ends of jetting head 520 to slide past the extension pipes 574 and 576 so that an area wider than the distance between the pulling pipes 600 and 600*a* can be cut. In the preferred embodiment, the cut outs or grooves allow the jetting head 520 to create 11' wide panels.

A trailing pipe 590 preferably trails the pulling pipe 600*a*, as shown in FIG. 42. The trailing pipe 590 is connected to the cutting device 510 by a chain or flexible cable 592, as shown in FIG. 42. The trailing pipe 590 again is preferably made of the same materials as pulling pipes 600 and 600*a*, i.e., 2⅜" O.D. steel oil well tubes. As with the other embodiments utilizing a trailing pipe, once a "pull" is complete, the trailing pipe 590 becomes the pulling pipe 600' (shown in FIG. 33) used to move the cutting device 510 through the subsurface soil to form another panel integral with the first. The advantages of this trailing method have been pointed out above.

Although the preferred embodiments of this invention have been described herein above in some detail, it should be appreciated that a variety of embodiments will be readily available to a person designing such subsurface containment barrier construction apparatus for a specific end use. The description of the apparatus and method of this invention is not intended to be limiting on this invention, but merely is illustrative of the preferred embodiment of this invention. Other apparatus and methods which incorporate modifications or changes to that which has been described herein are equally included within this application.

What is claimed is:

1. An apparatus for constructing a containment barrier around and under a waste site disposal in soil, comprising:

means for cutting a continuous elongate cut through the soil from one side of the waste site to another side of the waste site such that the cut spans the waste site without intersecting the waste site;

means for displacing through the soil and along and under the waste site said cutting means so as to propagate such a cut transversely to its length and along and under the waste site;

means for placing a barrier material in the transversely propagated elongate cut; and wherein said displacing means includes transport means for moving said cutting means and said conduit means relative to the waste site.

2. An apparatus as defined in claim 1, wherein:

said cutting means includes an arcuate member having two ends; and said displacing means includes transport means, connected to the two ends of the arcuate member, for moving the arcuate member relative to the waste site.

3. An apparatus as defined in claim 1, wherein the transport means includes a first vehicle connected to one end of the cutting means, and a second vehicle connected to the other end of the cutting means.

4. An apparatus for forming a containment barrier in the earth below a waste site, which comprises: a soil cutter capable of cutting a continuous elongate cut through the soil from one side of the waste site to another side of the waste site such that the cut spans the waste site; and means for displacing said cutter along and under the waste site so as to propagate such a cut transversely to its length and along and under the waste site.

5. An apparatus for forming a containment barrier in the earth below a waste site, which includes: a soil cutter adapted to be positioned in an elongate trench which is disposed beyond one end of the site and transverse relative to the site, said cutter being operable to make a cut in a wall of the trench toward the site and extending beyond each side of the site; and a power unit connected to the cutter to direct the cutter along and below the waste site and thereby cause the cut to penetrate beyond the wall of the trench and along and below the waste site.

6. An apparatus of claim 5 wherein the power unit is located at the surface of the earth connected to the soil cutter and operable to pull and support member in a direction to cause the earth cutting elements to cut into the earth.

7. A method of constructing a subsurface containment barrier in soil around and under a waste disposal site, comprising:

(a) cutting into soil along a continuous locus extending into the soil from two locations on the surface of the soil such that the locus extends around and under the waste site without intersecting it;

(b) in conjunction with step (a), emplacing with cut soil a fluidized barrier material in the locus around and under the waste site; and (c) repeating steps (a) and (b) while moving the locus throughout a transverse continuum surrounding and under the waste site.

8. A method as defined in claim 7, wherein said steps (a) through (b) include moving an orifice along said locus and emitting said fluidized barrier material from said orifice so that said fluidized barrier material is placed around and under the waste site and fills in after the cut for hardening into a solidified barrier.

9. A method as defined in claim 8, wherein said step (c) includes moving said orifice transversely to said first said locus.

10. A method as defined in claim 7, wherein said steps (a) and (b) include reciprocating a conduit along said locus, pumping said fluidized barrier material under pressure through said conduit, and jetting said fluidized barrier material from ports defined in said conduit.

11. A method as defined in claim 10, wherein said step (c) includes pulling said conduit transversely to said first said locus while performing said reciprocating, pumping and jetting steps of said steps (a) and (b).

12. A method as defined in claim 7, wherein step (c) includes pivoting a fluid conducting conduit throughout the transverse continuum surrounding and under the waste site.

* * * * *